US005500334A

United States Patent [19]

Mizukawa et al.

[11] Patent Number: 5,500,334

[45] Date of Patent: Mar. 19, 1996

[54] SILVER HALIDE COLOR PHOTOGRAPHIC MATERIAL CONTAINING PYRAZOLE-SUBSTITUTED COUPLERS

[75] Inventors: Yuki Mizukawa; Hideaki Naruse; Toshiyuki Watanabe; Tadahisa Sato, all of Kanagawa, Japan

[73] Assignee: Fuji Photo Film Co., Ltd., Kanagawa, Japan

[21] Appl. No.: 941,179

[22] Filed: Sep. 4, 1992

[30] Foreign Application Priority Data

Sep. 6, 1991 [JP] Japan ..... 3-254171

[51] Int. Cl.[6] ..... G03C 7/38

[52] U.S. Cl. ..... 430/558; 430/387

[58] Field of Search ..... 430/558, 386, 430/387

[56] References Cited

U.S. PATENT DOCUMENTS 5,001,041 3/1991 Kishimoto et al. ..... 430/558
5,254,446 10/1993 Ikenoue et al. ..... 430/558

FOREIGN PATENT DOCUMENTS 2091948 4/1987 Japan ..... 430/558
3284747 12/1991 Japan ..... 430/558
2132783 7/1984 United Kingdom ..... 430/558

*Primary Examiner*—Lee C. Wright
*Attorney, Agent, or Firm*—Birch, Stewart, Kolasch & Birch

[57] ABSTRACT

Disclosed is a silver halide color photographic material having at least one silver halide emulsion layer on a support, in which at least one layer constituting the material contains a coupler of formula (I):

(I)

where $R_1$ represents an electron-attracting substituent having a Taft's substituent constant $\sigma^*$ value of +0.52 or more; $R_2$ represents a branched alkyl group; and X represents a pyrazolyl group. The material has excellent heat stability, sensitivity, gradation and color image fastness, and it also has excellent color forming capacity and absorption characteristics.

14 Claims, No Drawings

SILVER HALIDE COLOR PHOTOGRAPHIC MATERIAL CONTAINING PYRAZOLE-SUBSTITUTED COUPLERS

FIELD OF THE INVENTION

The present invention relates to silver halide color photographic materials and also to useful 1H-pyrazolo[ 1,5-b][1,2,4]triazole magenta couplers to be in the materials.

BACKGROUND OF THE INVENTION 1H-pyrazolo[1,5-b][1,2,4]triazole magenta couplers are disclosed in JP-A 59-171956 and U.S. Pat. No. 4,540,654. (The term "JP-A" as used herein means an "unexamined published Japanese patent application".) These couplers are known to have excellent color reproducibility and give fast color images and they are also known to be produced easily. 6-Oxygen-substituted 1H-pyrazolo[1,5-b][1,2,4]-triazole couplers having improved sensitivity and gradation are disclosed in JP-A-62-209457 and European Patent Laid-Open No. 226849. The split-off group of the couplers specifically illustrated in the specifications is a halogen atom, an arylthio group, an aryloxy group or a phthalimido group. The couplers have a drawback in that they are unstable to heat. Of these known couplers, those having an arylthio split-off group are stable, but this group, when split off therefrom by coupling with an oxidation product of an aromatic primary amine or by color development of them, has a harmful influence on silver halides. Therefore, it is indispensably necessary to increase the molecular weight of the couplers, which, however, is inconvenient especially to the sharpness of picture-taking photographic materials. For the purpose of obtaining a sufficient sharpness of picture-taking photographic materials, incorporation of couplers having high color forming capacity, i.e., the capacity for forming satisfactory color images into them, is desired. In this respect, the known couplers are insufficient and unsatisfactory.

JP-A-2-59584 mentions production of 6-oxygen-substituted 1H-pyrazolo[1,5,-b][1,2,4]triazole couplers having a pyrazolyl group as the split-off group. However, these couplers interact with silver halides, and therefore have a drawback in that they lower the sensitivity of photographic materials. In addition, they have another drawback in that the magenta dyes to be formed therefrom by color development are often broadened.

SUMMARY OF THE INVENTION

The first object of the present invention is to provide a 1H-pyrazolo[1,5-b][1,2,4]triazole magenta coupler having excellent heat stability. The second object of the present invention is to provide a silver halide color photographic material having excellent sensitivity and gradation and forming a fast color image. The third object of the present invention is to provide a silver halide color photographic material capable of forming a color image having a high color density and good absorption characteristics, though containing a small amount of oil (a high boiling organic solvent) therein.

The above-mentioned objects have been attained by provision of a silver halide color photographic material containing a coupler of a general formula (I):

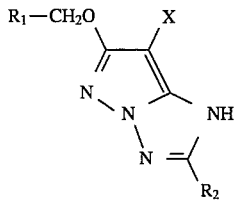

(I)

where $R_1$ represents an electron-attracting substituent having a Taft's substituent constant σ* value of +0.52 or more; $R_2$ represents a branched alkyl group; and X represents a substituted or unsubstituted pyrazolyl group.

DETAILED DESCRIPTION OF THE INVENTION

Couplers of formula (I) will be explained in detail hereunder.

Taft's substituent constant σ* value for $R_1$ is described in, for example, Taft, R. W. Jr., "Steric Effects in Organic Chemistry" (M. S. Newman, Ed.), John Wiley, New York (1956), pp. 556–675.

The substituent constant σ* value as referred to herein does not mean that $R_1$ is defined to include only the substituents described in the above-mentioned reference; $R_1$ also includes any other substituents that fall within the defined range, even though the value of them is not mentioned in the reference. More preferably, $R_1$ is a substituent having a substituent constant σ* value of from +0.52 to +1.30. Specific examples of these substituents include the methoxymethyl group, the hydroxymethyl group, the phenyl group, the phenoxymethyl group and the 2,2,2-trichloroethyl group, which, however, are not limitative.

Especially preferably, $R_1$ is a substituent having a substituent constant σ* value of from +0.52 to +0.92. Within this range, $R_1$ is most preferably represented by the following general formula (II):

$$—CH_2O—R_3 \quad \text{(II)}$$

where $R_3$ represents an alkyl group or an aryl group.

The alkyl group and aryl group of $R_3$ will be explained in detail herein. The alkyl group is a linear or branched, substituted or unsubstituted alkyl group. As substituents for the substituted alkyl group, for example, there are mentioned a halogen atom (e.g., fluorine, chlorine), an aryl group (e.g., phenyl, p-tolyl), a heterocyclic group (e.g., 4-pyridyl, 2-furyl), a hydroxyl group, an alkoxy group (e.g., methoxy, ethoxy, butoxy), an aryloxy group (e.g., phenoxy, 4-methoxyphenoxy, 2,4-di-t-amylphenoxy), an alkylthio group (e.g., ethylthio, octylthio), an arylthio group (e.g., phenylthio, 4-dodecyloxyphenylthio), an acyl group (e.g., acetyl, pivaloyl, benzoyl), a carbamoyl group (e.g., N,N-diethylcarbamoyl, N-butylcarbamoyl, N-phenylcarbamoyl), an amido group (e.g., acetamido, benzamido), an ureido group (e.g., N,N-dimethylureido, N-phenylureido), a sulfonamido group (e.g., methanesulfonamido, p-toluenesulfonamido), an alkyloxycarbonyl group (e.g., methoxycarbonyl, ethoxycarbonyl, dodecyloxycarbonyl), and a cyano group.

Of the alkyl groups, preferred is an unsubstituted linear or branched alkyl group.

The aryl group of $R_3$ is a substituted or unsubstituted aryl group. As substituents for the substituted aryl group, for example, those mentioned for the aforesaid substituted alkyl group are referred to. Of the aryl groups, preferred is a phenyl group.

$R_2$ in formula (I) represents a branched alkyl group of the following general formula (III):

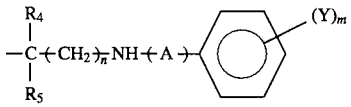

(III)

where $R_4$ and $R_5$ each represent a hydrogen atom, an alkyl group or an aryl group, but both $R_4$ and $R_5$ must not be hydrogen atoms; n represents 0, 1 or 2; A represents —CO— or —$SO_2$—; Y represents a substituent; and m represents an integer of from 0 to 5.

The alkyl group of $R_4$ and $R_5$ is a substituted or unsubstituted, linear or branched alkyl group. As substituents for the substituted alkyl group, there are mentioned, for example, a halogen atom (e.g., fluorine, chlorine), a cyano group, a carboxyl group, a hydroxyl group, an alkoxy group (e.g., methoxy, ethoxy, propoxy, butoxy, octyloxy, dodecyloxy, hexadecyloxy), an aryloxy group (e.g., phenoxy, naphthoxy, 2,4-di-t-amylphenoxy, 4 -t-octylphenoxy, 4-methoxyphenoxy, 2-methoxyphenoxy), an alkylthio group (e.g., methylthio, ethylthio, butylthio, octylthio, dodecylthio), an arylthio group (e.g., phenylthio, naphthylthio, 4-dodecyloxyphenylthio, 2-butoxy-5-t-octylphenylthio, 2-pivaloylamidophenylthio), an alkoxycarbonyl group (e.g., methoxycarbonyl, ethoxycarbonyl, dodecyloxycarbonyl, 2-ethylhexyloxycarbonyl), an acyloxy group (e.g., acetyloxy, pivaloyloxy, hexadecanoyloxy), an acylamino group (e.g., acetylamino, pivaloylamino, hexadecanoylamino, benzoylamino, α-(2,4-di-t-amylphenoxy)butylamido, 2-octadecyloxybenzoylamido), a sulfonamido group (e.g., methanesulfonamido, ethanesulfonamido, butanesulfonamido, decanesulfonamido, hexadecanesulfonamido, paratoluenesulfonamido, 2-octyloxy-5-t-octylbenzenesulfonamido, 4-dodecyloxybenzenesulfonamido), an ureido group (e.g., phenylureido, N,N-dibutylureido), a sulfamoylamino group (e.g., N,N-dipropylsulfamoylamino, N-butylsulfamoylamino), an anilino group (e.g., phenylamino, 2-chloroanilino), a carbamoyl group (e.g., N-ethylcarbamoyl, N,N-dibutylcarbamoyl), a sulfamoyl group (e.g., N-ethylsulfamoyl, N,N-dipropylsulfamoyl), an alkoxycarbonylamino group (e.g., methoxycarbonylamino, tetradecyloxycarbonylamino), and a sulfonyl group (e.g., methylsulfonyl, ethylsulfonyl, butylsulfonyl, benzenesulfonyl). The substituted alkyl group may have two or more of these substituents, which may be the same as or different from one another.

The aryl group of $R_4$ and $R_5$ is a substituted or unsubstituted aryl group. As substituents for the substituted aryl group, those for the aforesaid substituted alkyl group are referred to.

Most preferably, when $R_4$ is a hydrogen atom or an unsubstituted linear or branched alkyl group, $R_5$ is an unsubstituted linear or branched alkyl group or an unsubstituted aryl group.

n represents 0, 1 or 2; and it is most preferably 1.

A represents —CO— or —$SO_2$—; and it is most preferably —$SO_2$—.

Y represents a substituent which may be further substituted, including, for example, a halogen atom (e.g., fluorine, chlorine, bromine), a cyano group, a carboxyl group, a hydroxyl group, an alkoxy group (e.g., methoxy, ethoxy, propoxy, butoxy, octyloxy, 2-ethylhexyloxy, dodecyloxy, tetradecyloxy, hexadecyloxy, 2-methoxyethoxy, 2-phenoxyethoxy), an aryloxy group (e.g., phenoxy, 4-methoxyphenoxy, 4-methylphenoxy, 2-methoxyphenoxy, 4-chlorophenoxy, 4-t-butylphenoxy, 3-pentadecylphenoxy, 2,4-dimethylphenoxy, 4-methylsulfonylphenoxy, 4-t-octylphenoxy, 2,4-di-t-amylphenoxy), an alkylthio group (e.g., methylthio, ethylthio, butylthio, octylthio, dodecylthio), an arylthio group (e.g., phenylthio, 4-dodecyloxyphenylthio, 2-butoxy-5-t-octylphenylthio), an alkoxycarbonyl group (e.g., methoxycarbonyl, ethoxycarbonyl, dodecyloxycarbonyl, 2-ethylhexyloxycarbonyl, isohexadecyloxycarbonyl), an acylamino group (e.g., acetylamino, pivaloylamino, tetradecanoylamino, hexadecanoylamino, N-methyl-dodecanoylamino, 2,4-di-t-amylphenoxyacetylamino, α-(2,4-di-t-amylphenoxy)butanoylamino, α -(2,4-di-t-amylphenoxy)hexanoylamino, α-(2,4-di-t-amylphenoxy)octanoylamino, 2-octadecyloxybenzoylamino), a sulfonamido group (e.g., methanesulfonamido, ethanesulfonamido, hexadecanesulfonamido, benzenesulfonamido, 2 -octyloxy-5-t-octylbenzenesulfonamido, N-methyl-2-butoxy-5 -t-octylbenzenesulfonamido, N-butyl-4-dodecyloxybenzenesulfonamido), an ureido group (e.g., phenylureido, N,N-dioctylureido), a sulfamoylamino group (e.g., N,N-dipropylsulfamoylamino, N-dodecylsulfamoylamino), an anilino group (e.g., phenylamino, 2-chloro-5-tetradecanoylaminoanilino), a carbamoyl group (e.g., N-octylcarbamoyl, N,N-dioctylcarbamoyl), a sulfamoyl group (e.g., N-butylsulfamoyl, N,N-dioctylsulfamoyl), an alkoxycarbonylamino group (e.g., methoxycarbonylamino, tetradecyloxycarbonylamino), a sulfonyl group (e.g., methylsulfonyl, ethylsulfonyl, benzenesulfonyl), or an amino group (e.g., dibutylamino, dioctylamino, methyloctadecylamino).

m represents an integer from 0 to 5. When m is an integer of from 2 to 5, then plural substituent Y's may be the same as or different from one another.

Preferably, $R_2$ represents a group of a general formula (IV):

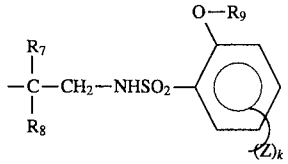

(IV)

where $R_7$ and $R_8$ have the same meanings as $R_4$ and $R_5$, respectively; $R_9$ represents an alkyl group or an aryl group; Z has the same meaning as Y; and k represents an integer of from 1 to 4.

$R_9$ will be explained in more detail herein.

$R_9$ is an alkyl group or an aryl group. The alkyl group is a substituted or unsubstituted, linear or branched alkyl group. As substituents for the substituted alkyl group, those for the aforesaid substituted alkyl group of $R_4$ and $R_5$ are referred to. The aryl group is a substituted or unsubstituted aryl group. As substituents for the substituted aryl group, those for the aforesaid substituted aryl group of $R_4$ and $R_5$ are referred to. Preferably, $R_9$ is an aryl group.

Most preferably, $R_2$ is a group of a general formula (V):

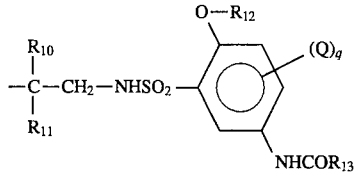

(V)

where $R_{10}$ and $R_{11}$ have the same meanings as $R_4$ and $R_5$, respectively; $R_{12}$ has the same meaning as $R_9$; Q has the same meaning as Y; q represents an integer of from 0 to 3; and $R_{13}$ represents an alkyl group or an aryl group.

$R_{13}$ will be explained in more detail herein.

$R_{13}$ is an alkyl group or an aryl group. The alkyl group is a substituted or unsubstituted alkyl group. As substituents for the substituted alkyl group, those for the aforesaid substituted alkyl group of $R_4$ and $R_5$ are referred to. The aryl group is a substituted or unsubstituted aryl group. As substituents for the substituted aryl group, those for the aforesaid substituted aryl group of $R_4$ and $R_5$ are referred to. Preferably, $R_9$ is an aryl group.

The group represented by $R_2$ may contain 3 to 60 carbon atoms, more preferably 4 to 48 carbon atoms. When $R_3$ is an alkyl group, the group may contain 1 to 36 carbon atoms, more preferably 1 to 24 carbon atoms, and most preferably 1 to 12 carbon atoms. When $R_3$ is an aryl group, the group may contain 6 to 36 carbon atoms, more preferably 6 to 18 carbon atoms. When $R_4$, $R_5$, $R_7$, $R_8$, $R_{10}$ and $R_{11}$ are each an alkyl group, each of these groups may contain 1 to 20 carbon atoms, more preferably 1 to 12 carbon atoms, and most preferably 1 or 2 carbon atoms. When $R_4$, $R_5$, $R_7$, $R_8$, $R_{10}$ and $R_{11}$ are each an aryl group, each of these groups may contain 6 to 20 carbon atoms, more preferably 6 to 14 carbon atoms. When $R_9$ and $R_{12}$ are each an alkyl group, each of these groups may contain 1 to 50 carbon atoms, more preferably 1 to 18 carbon atoms. When $R_9$ and $R_{12}$ are each an aryl group, each of these groups may contain 6 to 42 carbon atoms, more preferably 6 to 16 carbon atoms. When $R_{13}$ is an alkyl group, the group may contain 1 to 50 carbon atoms, more preferably 1 to 37 carbon atoms. When $R_{13}$ is an aryl group, the group may contain 6 to 50 carbon atoms, more preferably 6 to 30 carbon atoms. All of the above carbon atom numbers include those of a substituent.

Next, X will be explained.

X represents a substituted or unsubstituted pyrazolyl group. As substituents for the substituted pyrazolyl group, those for the aforesaid substituted alkyl group of $R_2$ are referred to. Preferred examples of X are mentioned below, which, however, are not limitative.

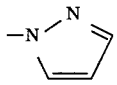

X-1

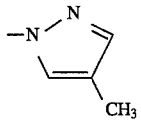

X-2

-continued

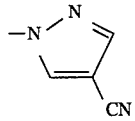

X-3

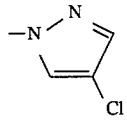

X-4

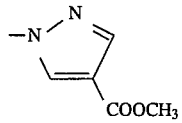

X-5

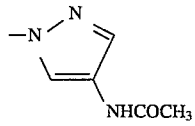

X-6

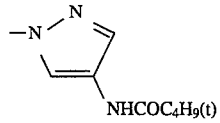

X-7

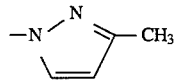

X-8

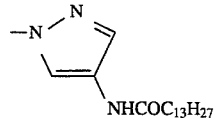

X-9

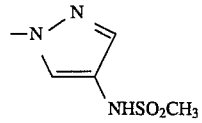

X-10

Specific examples of magenta couplers of the present invention are mentioned below, which, however, are not limitative.

($\sigma^* = +0.85$) M-1

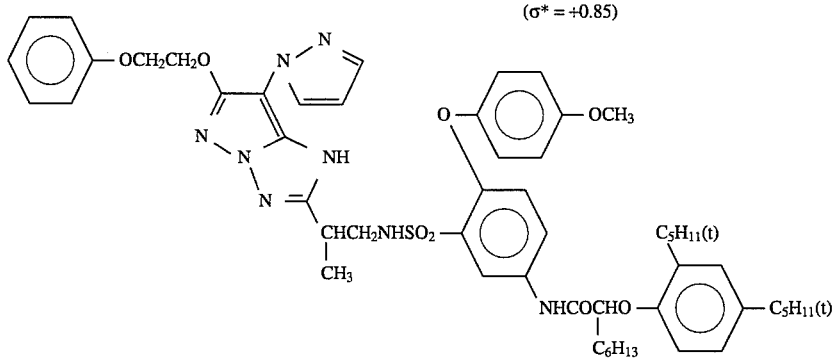

-continued
(σ* = +0.85) M-2
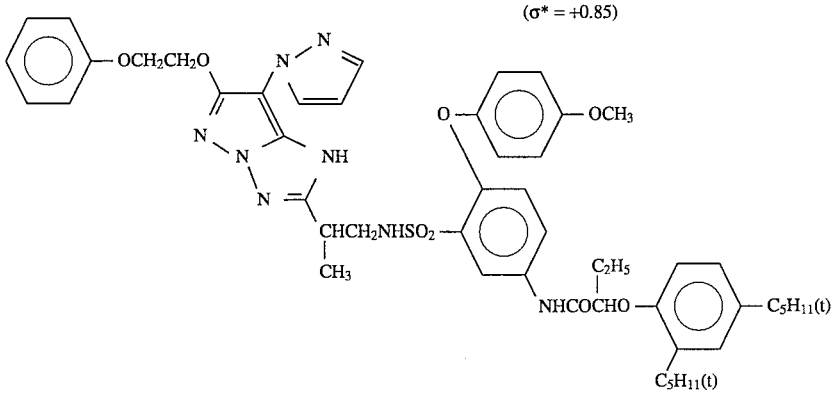
(σ* = +0.85) M-3
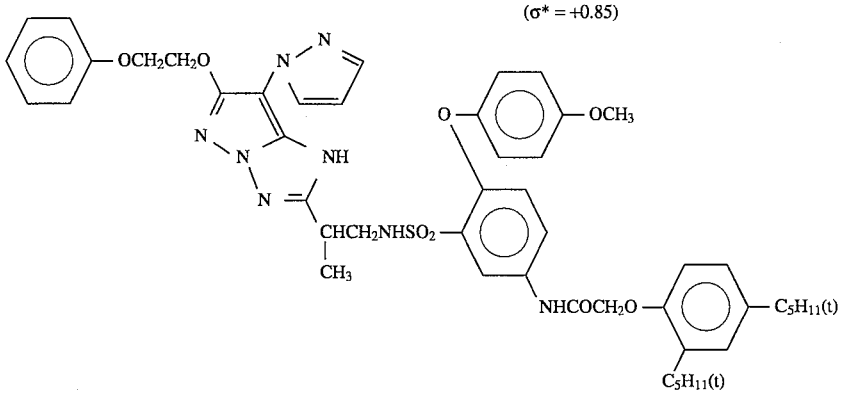
(σ* = +0.85) M-4
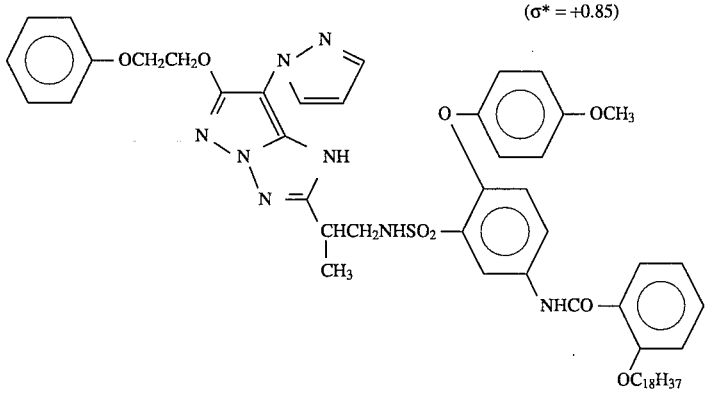
(σ* = +0.85) M-5
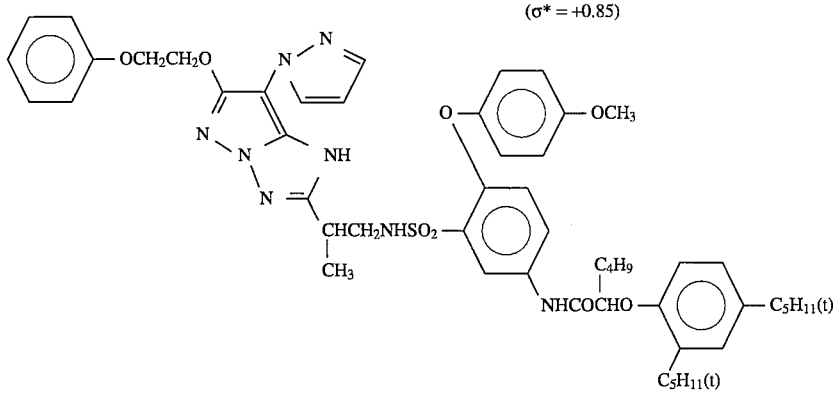

-continued
(σ* = +0.85) M-6
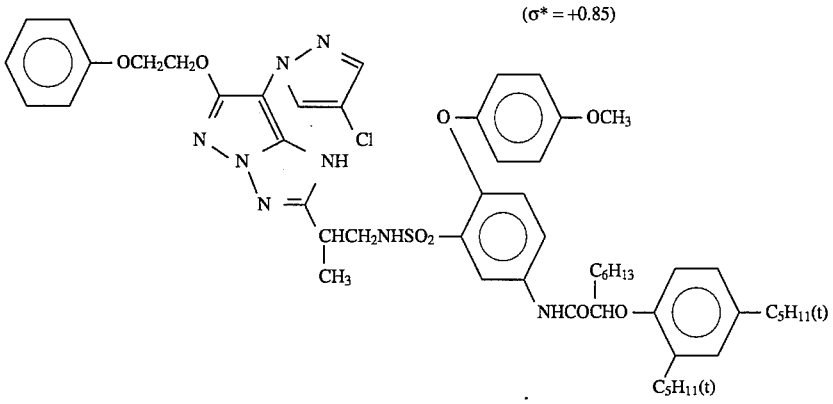
(σ* = +0.85) M-7
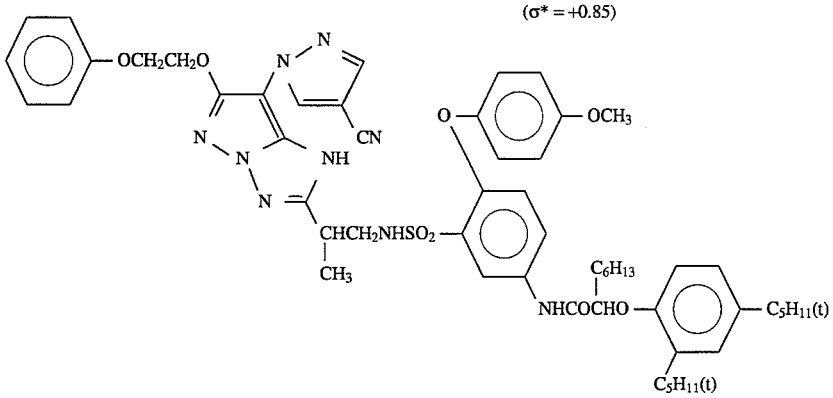
(σ* = +0.86) M-8
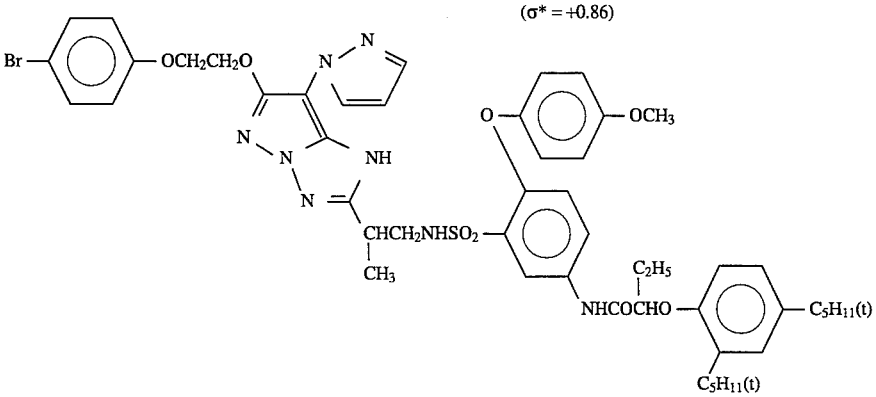
(σ* = +0.87) M-9
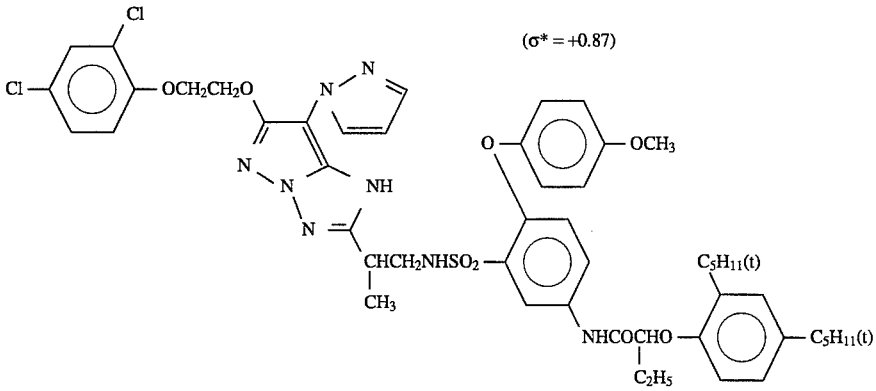

-continued
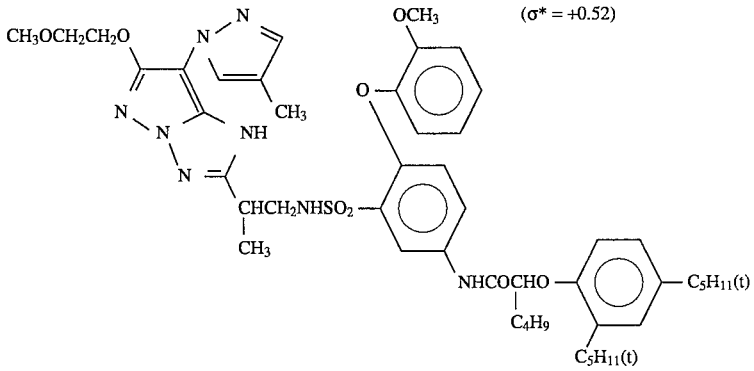
($\sigma^* = +0.52$) M-10
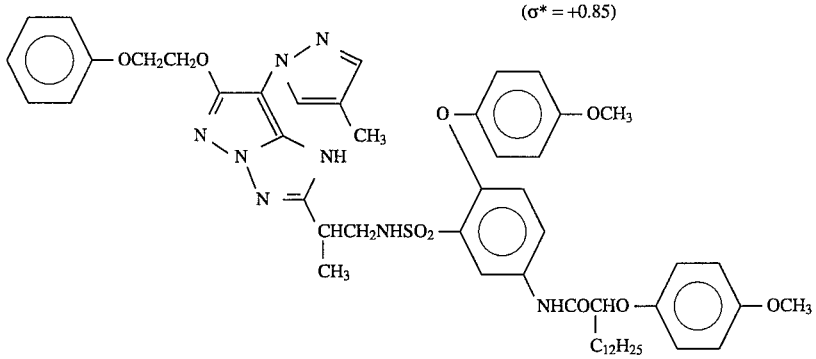
($\sigma^* = +0.85$) M-11
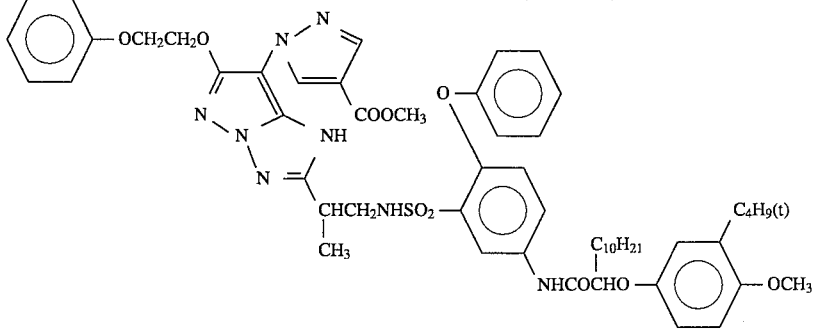
($\sigma^* = +0.85$) M-12
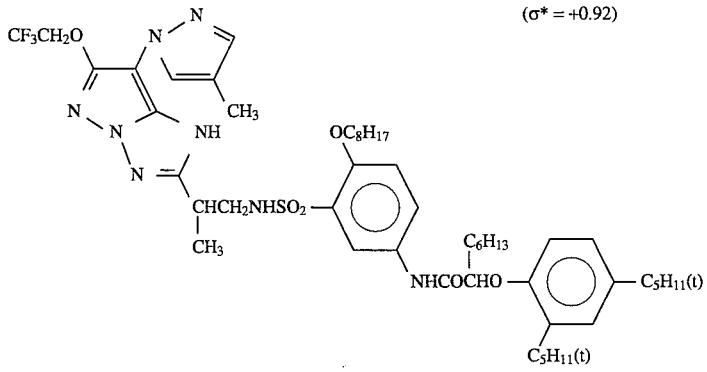
($\sigma^* = +0.92$) M-13

-continued
(σ* = +0.85) M-14
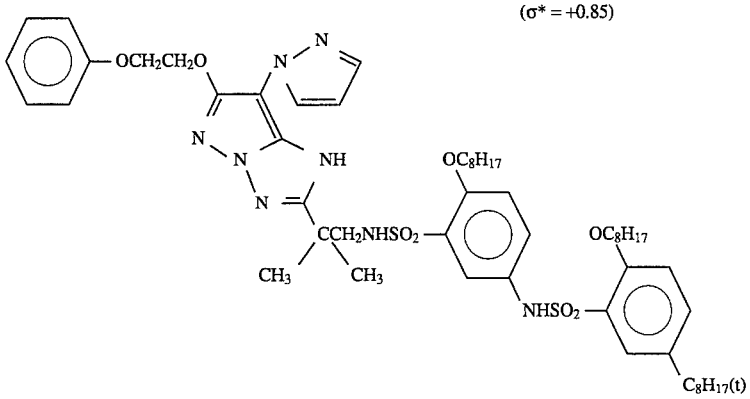
(σ* = +0.85) M-15
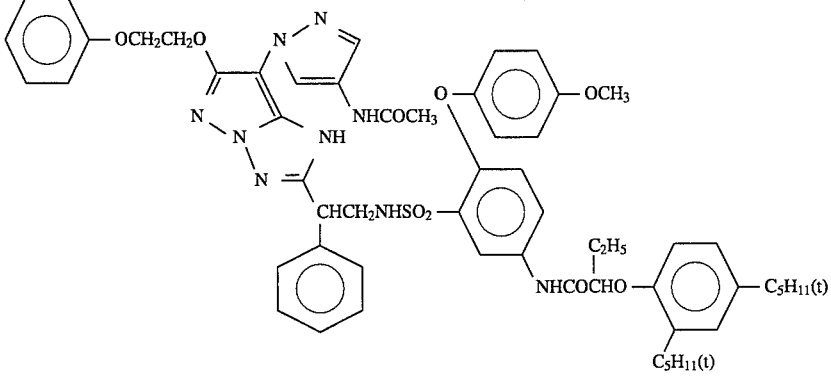
(σ* = +0.85) M-16
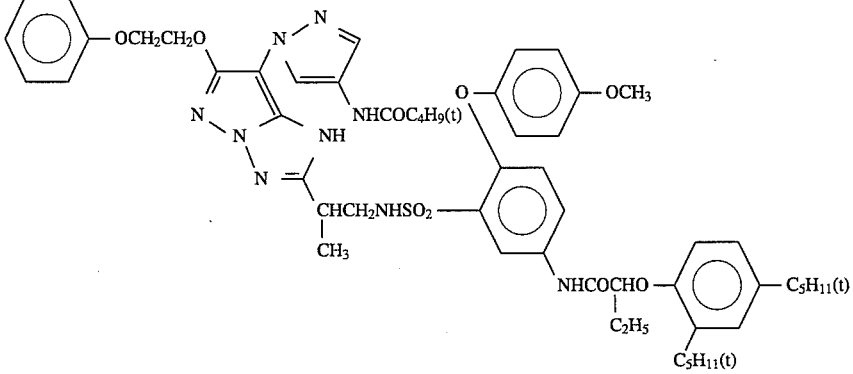
(σ* = +0.85) M-17
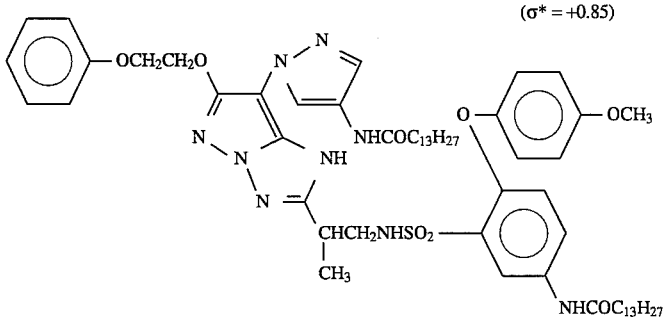

-continued
(σ* = +0.85) M-18
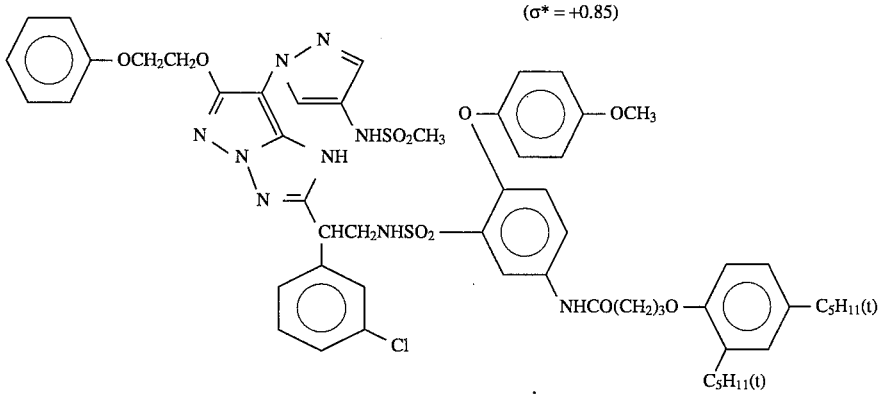
(σ* = +1.30) M-19
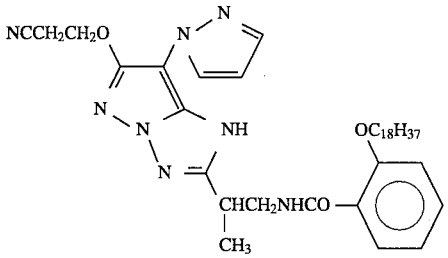
(σ* = +0.85) M-20
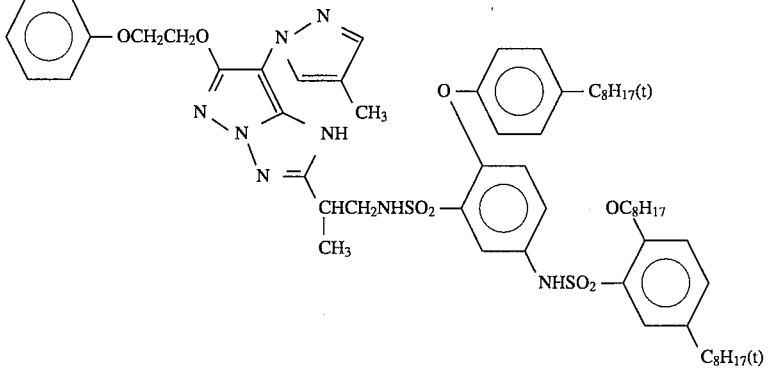
(σ* = +0.85) M-21
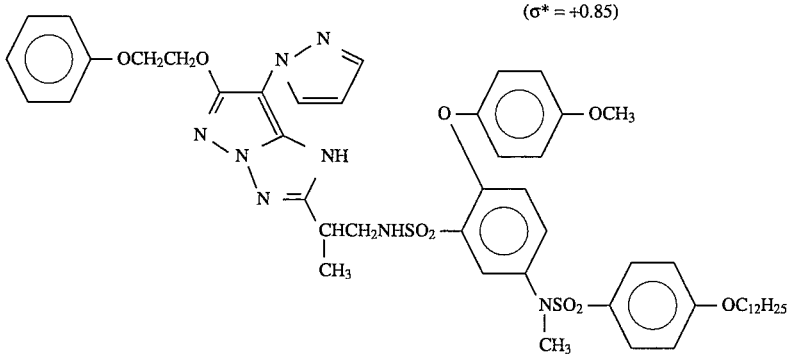

-continued
(σ* = +0.52) M-22
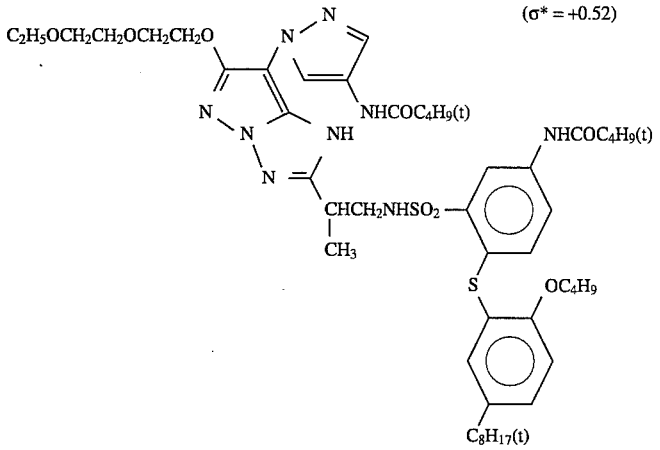
(σ* = +1.32) M-23
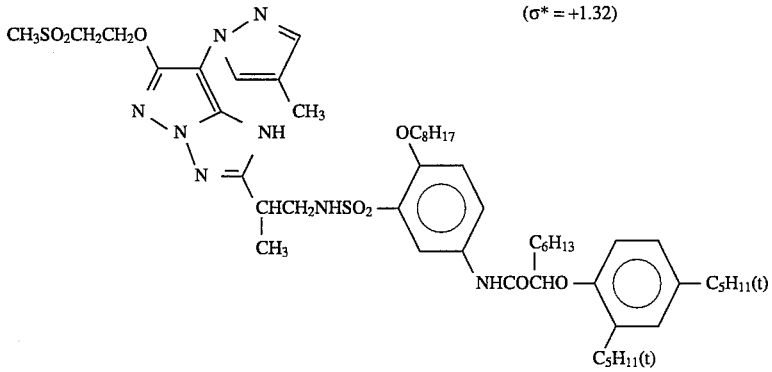
(σ* = +0.85) M-24
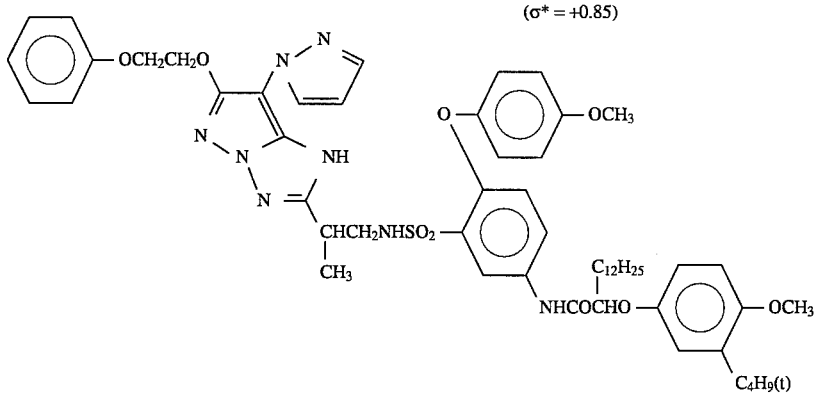
(σ* = +0.82) M-25
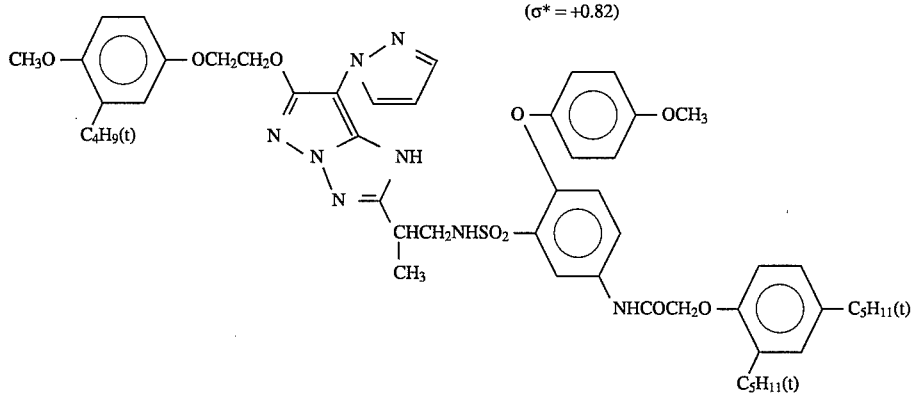

-continued

M-26

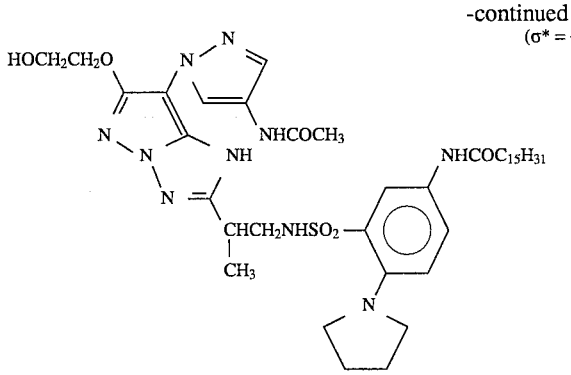

M-27

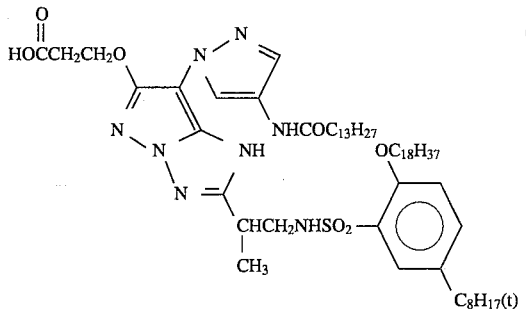

M-28

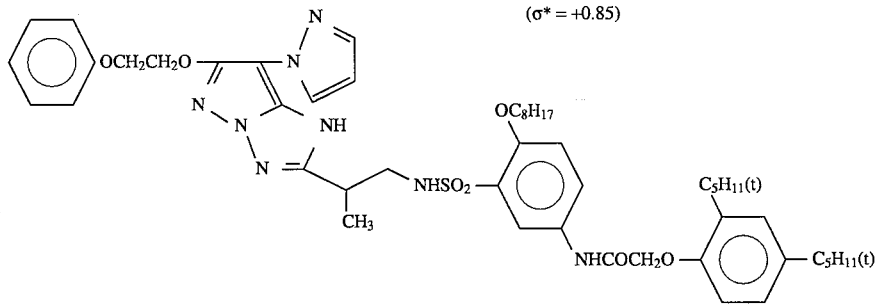

A general method of preparing the couplers of the present invention is shown below. A method of preparing a 1H-pyrazolo[1,5-b][1,2,4]triazole skeleton having an oxygen atom at the 6-position is described in JP-A-62- 209457. Introduction of a pyrazolyl group into the skeleton is described in JP-A-2-59584. The couplers of the present invention are produced in accordance with the following reaction scheme (A):

Reaction Scheme A:

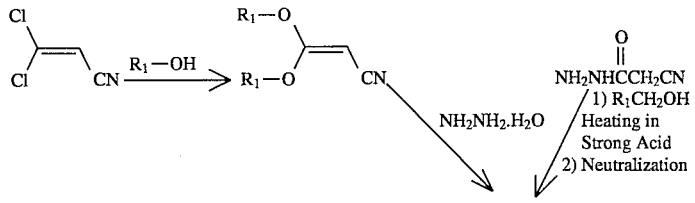

-continued
Reaction Scheme A:
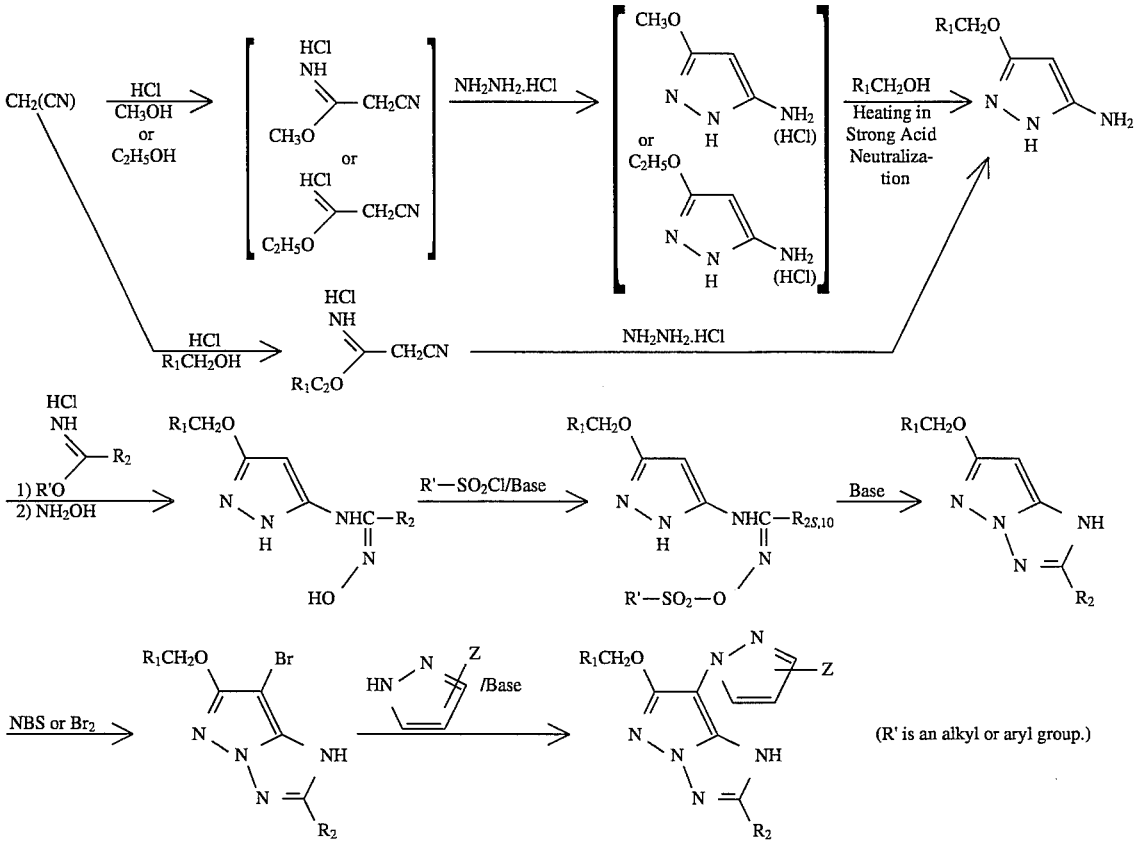
Examples of processes for producing the illustrated couplers are shown below.
Production Example 1: Production of Illustrated Coupler M-2
Coupler M-2 is produced in accordance with the following reaction scheme (B):
Reaction Scheme (B):
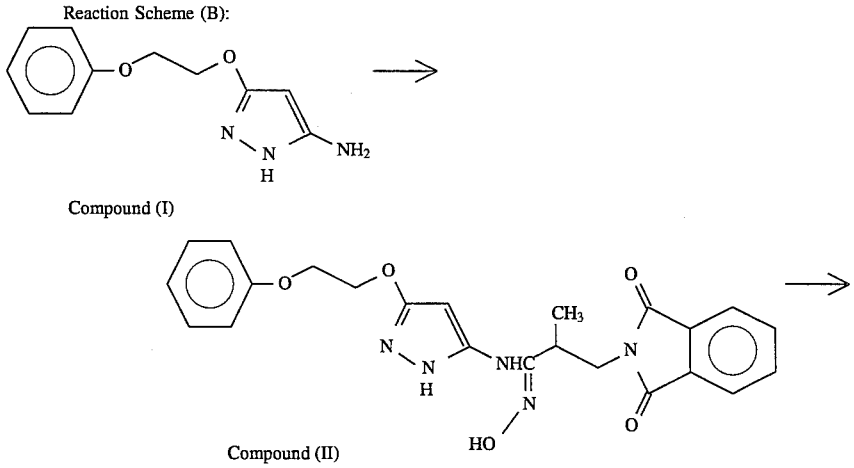

-continued

Reaction Scheme (B):

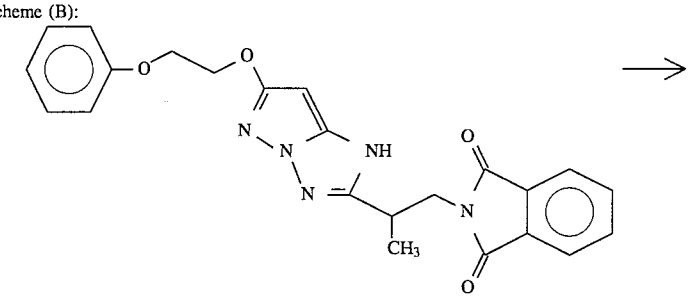

Compound (III)

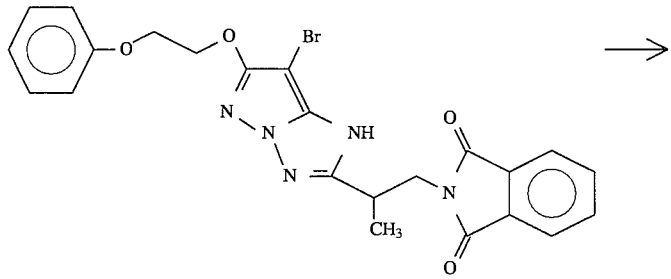

Compound (IV)

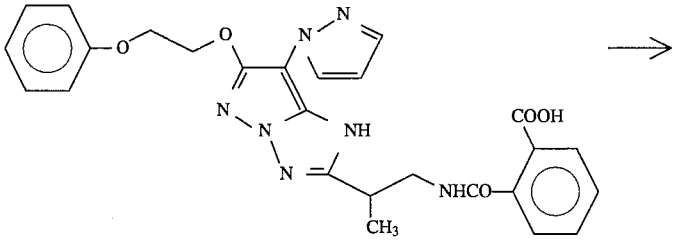

Compound (V)

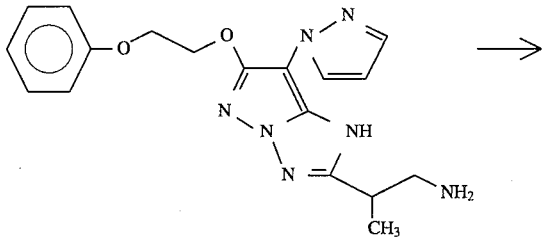

Compound (VI)

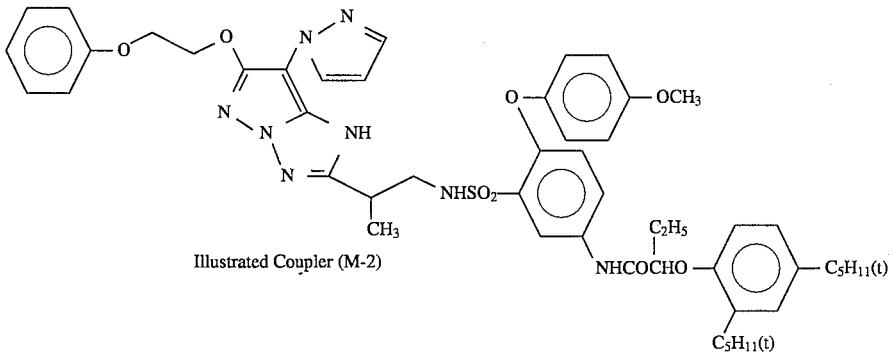

Illustrated Coupler (M-2)

Production Example 1

Production of Illustrated Coupler (M-2):

2000 ml of acetonitrile was added to 219.3 g (1.0 mol) of 3-amino-5-(2-phenoxyethoxy)pyrazole (compound (I)) and stirred at room temperature. To this was added 282.7 g (1.0 mol) of methyl-2-methyl-3-phthalimidopropionimido hydrochloride and stirred for 6 hours. Next, a methanol solution of hydroxylamine (as prepared from 139 g (2.0 mol)

of hydroxylamine hydrochloride and 402 g (2.0 mol) of SM-28) was added thereto and stirred for a further 7 hours at room temperature. After reaction, 4000 ml of water was added to the reaction system, and the crystals which precipitated were removed by filtration. The crystals were washed with water and acetonitrile and dried to obtain 324 g (yield: 72%) of an amidoxime product (compound (II)). This had a melting point of 140° to 142° C.

675 ml of dimethylacetamide was added to 225 g (0.5 mol) of the amidoxime product (compound (II)), cooled to 10° C. and stirred. To this was dropwise added 57.3 g (0.5 mol) of methanesulfonyl chloride. After addition, the whole was stirred for further about 30 minutes, and 44.5 ml (0.55 mol) of pyridine was dropwise added thereto. This was stirred for further one hour, and the reaction solution was poured into ice-water, whereupon the crystals which precipitated out were removed by filtration. The crystals were dispersed in 2000 ml of methanol, and 44.5 ml (0.55 mol) of pyridine was added thereto. This was heated at 50° C. to 55° C. and stirred for about 4 hours. The crystals which precipitated out were removed by filtration, washed with methanol and dried. Thus, 130.5 g (yield: 60.5%) of compound (III) was obtained. This had a melting point of 216° to 217° C.

48.5 ml (0.6 mol) of pyridine and 645 ml of acetonitrile were added to 129.4 g (0.3 mol) of compound (III), cooled to 5° C. and stirred. To this was gradually dropwise added 48.0 g (0.3 mol) of bromine. After addition, this was stirred for one hour with cooling with ice, and the reaction solution was poured into water. The crystals which precipitated out were removed by filtration and recrystallized from acetonitrile. Thus, 143.9 g (yield: 93.9%) of compound (IV) was obtained. This had a melting point of 165° to 167° C. (decomposition).

150 ml of 1,3-dimethyl-2-imidazolidone was added to 14.4 g (0.36 mol) of NaH (60% dispersion in oil) and stirred at room temperature. To this was added 17.7 g (0.26 mol) of pyrazole, little by little, at several different times. To the resulting solution was added 51.0 g (0.1 mol) of compound (IV) and this mixture was heated at 120° to 125° C. After stirring for about 5 hours, the reaction solution was cooled to room temperature. This was poured into ice-water, and 30 ml of concentrated hydrochloric acid was added thereto to make it acidic. The gummy product which precipitated out was separated, and methanol was added thereto, whereby the product crystallized. The crystals were removed by filtration and dried to obtain 30.9 g (yield: 59.8%) of compound (V).

m.p. 207° to 210° C. Proton NMR Spectrum (DMSO-$d_6$): δ(ppm) (multiplicity, integrated values) 13.15 (s, 1H), 12.93 (s, 1H), 8.50 (t, 1H), 7.90 to 7.15 (m, 8H), 7.0 (d, 3H), 6.45 (s, 1H), 4.60 to 4.30 (m, 4H), 3.65 to 3.45 (m, 1H), 3.40 to 3.20 (m, 1H), 1.37 (d, 3H).

250 ml of ethanol was added to 51.6 g (0.1 mol) of compound (V) and this mixture was heated under reflux. To this was added 4.8 g (0.05 mol) of methanesulfonic acid, and this was heated under reflux for a further 3 hours. Next, 10.0 g (0.1 mol) of hydrazine monohydrate was added thereto and heated under reflux for a further 3 hours. After reaction, the reaction solution was cooled to room temperature, and 17.2 ml of concentrated hydrochloric acid was added thereto and stirred for 30 minutes. The crystals which precipitated out were removed by filtration, and the filtrate was concentrated under reduced pressure to obtain compound (VI) as its hydrochloride. 200 ml of water and 200 ml of ethyl acetate were added to the hydrochloride and stirred at room temperature. To this was added 84 g (1.0 mol) of sodium hydrogencarbonate in several times. 58.5 g (0.095 mol) of 5-{2-(2,4-di-t-amylphenoxy)butylamido}-2-(4-methoxyphenoxy)-benzenesulfonyl chloride was added thereto. The resulting solution was stirred for 5 hours at room temperature. After reaction, this was filtered to remove the insoluble substances therefrom. The filtrate was extracted with ethyl acetate. The ethyl acetate layer was washed with an aqueous diluted hydrochloric acid solution and then with an aqueous solution of salt. The ethyl acetate solution was concentrated under reduced pressure, and a mixed solvent of n-hexane and ethyl acetate was added to the residue to form crystals. The crystals thus obtained were purified by recrystallizing them from a mixed solvent of n-hexane and ethyl acetate. Thus, 65.7 g (yield: 73.0%) of coupler (M-2) was obtained.

m.p. 158° to 159° C. Proton NMR Spectrum ($CDCl_3$): δ(ppm) (multiplicity, integrated values): 12.15 (br, 1H), 8.0 (d, 1H), 7.88 to 7.70 (m, 2H), 7.52 to 7.20 (m, 5H), 7.15 to 6.50 (m, 10H), 6.32 to 6.24 (m, 1H), 5,80 (t, 1H), 4.80 to 4.60 (m, 3H), 4.40 to 4.22 (m, 2H), 3,72 (s, 3H), 3,48 to 3.01 (m, 3H), 2.23 to 1.80 (m, 4H), 1,70 to 0.60 (m, 26H).

Production Examples 2 to 9

In a similar manner as in Production Example 1, couplers (M-1) and (M-3) to (M-9) were produced. Melting points and NMR data of these couplers are shown in Table 1 below.

TABLE 1

| Coupler No. | m.p. (°C.) | Proton NMR δ (ppm), (multiplicity, integrated values) |
|---|---|---|
| M-1 | glassy | ($CDCl_3$), 12.10(br, 1H), 7.97(d, 1H), 7.85–7.75(m, 2H), 7.50–7.20(m, 5H), 7.18–6.77(m, 8H), 6.75–6.50(m, 2H), 6.30–6.25(m, 1H), 5.80(t, 1H), 4.80–4.62(m, 3H), 4.33(t, 2H), 3.73(S, 3H), 3.50–3.09(m, 3H), 2.15–1.85(m, 4H), 1.70–1.06(m, 25H), 0.89(t, 3H), 0.78–0.60(m, 6H) |
| M-3 | 128–129 | ($CDCl_3$)11.57(br, 1H), 8.37(S, 1H), 7.98(d, 1H), 7.86(d, 1H), 7.48(d, 1H), 7.37–7.12(m, 5H), 7.10–6.75(m, 8H), 6.47(d, 1H), 6.33–6.25(m, 1H), 5.80(t, 1H), 4.78–4.60(br, 4H), 4.40–4.28(br, 2H), 3.30(S, 3H), 3.65–3.25(m, 3H), 1.89(q, 2H), 1.63 (q, 2H) 1.45(S, 6H), 1.35–1.20(m, 9H), 0.79–0.60(m, 6H) |
| M-4 | 91–93 | ($CDCl_3$)9.99(S, 1H), 8.34(dd, 1H), 8.0(d, 1H), 7.80(d, 1H), 7.60–7.50 (m, 1H), 7.40–6.70(m, 12H), 6.35(d, 1H), 6.23–6.10(m, 1H), 5.77(t, 1H), 4.73(t, 2H), 4.35(t, 2H), 4.22(t, 2H), 3.76(S, 3H), 3.68–3.40(m, 3H), 2.03–1.70(m, 2H), 1.53–0.75(m, 38H) |
| M-5 | 135–138 | ($CDCl_3$)11.72(br, 1H), 7.97(d, 1H), 7.85–7.70(m, 2H), 7.48–7.15(m, 5H), 7.17–6.76(m, 9H), 6.70(dd, 1H), 6.55 (dd, 1H), 6.30–6.22(m, 1H), 5.80(t, 1H), 4.80–4.58(m, 3H), 4.33(t, 2H), 3.75(S, 3H), 3.50–3.03(m, 3H), 2.15–1.80(m, 4H), 1.70–0.6(m, 29H) |
| M-6 | glassy | ($CDCl_3$)11.15(S, 1H), 7.98(d, 1H), 7.90–7.74(m, 2H), 7.40–6.64(m, 14H), 6.41(dd, 1H), 5.90(t, 1H), 4.82–4.57 (m, 3H), 4.33(t, 2H), 3.74(S, 3H), 3.63–3.20(m, 3H), 2.18–1.80(m, 4H), 1.73–0.58(m, 34H) |
| M-7 | glassy | ($CDCl_3$)11.05(S, 1H), 8.18(S, 1H), 8.06–7.30(m, 2H), 7.65(d, 1H), 7.42–6.65(m, 13H), 6.42(dd, 1H), 5.90(t, 1H), 4.83–4.64(m, 3H), 4.37(t, 2H), 3.74(S, 3H), 3.61–3.24(m, 3H), 2.20–1.84(m, 4H), 1.72–1.10(m, 25H), 1.40 (t, 3H), 0.8–0.58(m, 6H) |
| M-8 | 163–166 | ($CDCl_3$)8.0(d, 1H), 7.88–7.70(m, 2H), 7.53–7.21(m, 6H), 7.20–6.65(m, 9H), 6.60–6.43(m, 1H), 6.35–6.28(m, 1H), |

TABLE 1-continued

| Coupler No. | m.p. (°C.) | Proton NMR δ (ppm), (multiplicity, integrated values) |
|---|---|---|
| | | 5.77(t, 1H), 4.82–4.60(m, 3H), 4.35 (t, 2H), 3.77(S, 3H), 3.57–3.10(m, 3H), 2.23–2.05(m, 2H), 2.04–1.87(m, 2H), 1.73–0.55(m, 25H) |
| M-9 | 155–158 | — |

The amount of the magenta coupler represented by formula (I) of the present invention is about 0.005 g/m$^2$ to 2.0 g/m$^2$, preferably 0.01 g/m$^2$ to 1.0 g/m$^2$.

The photographic material of the present invention is not particularly limited, provided that it has at least one blue-sensitive silver halide emulsion layer, at least one green-sensitive silver halide emulsion layer and at least one red-sensitive silver halide emulsion layer on a support. In the material, the number of the silver halide emulsion layers and non-light-sensitive layers as well as the order of the layers on the support is not particularly limited. As one typical example, there is mentioned a silver halide color photographic material having plural light-sensitive layer units each composed of plural silver halide emulsion layers each having substantially the same color-sensitivity, but having a different degree of sensitivity. The respective light-sensitive layers are unit light-sensitive layers each having a color-sensitivity to any one of blue light, green light or red light. In such a multi-layer silver halide color photographic material, in general, the order of the light-sensitive layer units to be on the support comprises a red-sensitive layer unit, a green-sensitive layer unit and a blue-sensitive layer unit, as formed on the support in this order. However, the order of the layers may be opposite to the above-mentioned order, in accordance with the object of the photographic material. In still another embodiment, a different color-sensitive layer may be sandwiched between two other layers having the same color-sensitivity.

Various non-light-sensitive layers, such as interlayers, may be provided between the above-mentioned silver halide light-sensitive layers, or on or below the uppermost layer or lowermost layers.

Such an interlayer may contain various couplers and DIR compounds such as those described in JP-A-61- 43748, JP-A-59-113438, JP-A-59-113440, JP-A-61-20037 and JP-A-61-20038, and it may also contain conventional color mixing preventing agents.

As the constitution of the plural silver halide emulsions constituting the respective light-sensitive layer units, preferred is a two-layered constitution composed of a high-sensitivity emulsion layer and a low-sensitivity emulsion layer as described in West German Patent 1,121,470 and British Patent 923,045. In general, it is preferred that the plural light-sensitive layers are arranged on the support in such a way that the sensitivity degree of the layer is to gradually decrease in the direction of the support. In this embodiment, a non-light-sensitive layer may be provided between the plural silver halide emulsion layers. In another embodiment, a low-sensitivity emulsion layer is formed remote from the support, and a high-sensitivity emulsion layer is formed near to the support, as so described in JP-A-57-112751, JP-A-62-200350, JP-A-62-206541, and JP-A-62-206543.

As specific examples of the layer constitution on the support, there are mentioned an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; and an order of BH/BL/GL/GH/RH/RL; and an order of BH/BL/GH/GL/RL/RH.

As other examples, there are mentioned an order of blue-sensitive layer/GH/RH/GL/RL from the remotest side from the support, as described in JP-B-55-34932; and an order of blue-sensitive layer/GL/RL/GH/RH from the remotest side from the support, as described in JP-A-56-25738 and JP-A-62-63936.

As further example, there is mentioned a three-layer unit constitution as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of this type, the sensitivity degree of each emulsion layer is gradually lowered in the direction of the support. Even in the three-layer constitution of this type, each of the same color-sensitivity layers may be composed of three layers of middle-sensitivity emulsion layer/high-sensitivity emulsion layer/low-sensitivity emulsion layer as formed in this order from the remotest side from the support, as so described in JP-A-59-202464.

As still other examples of the layer constitution of the photographic material of the present invention, there are mentioned an order of high-sensitivity emulsion layer/low-sensitivity emulsion layer/middle-sensitivity emulsion layer, and an order of low-sensitivity emulsion layer/middle-sensitivity emulsion layer/high-sensitivity emulsion layer.

Where the photographic material of the invention has four or more layers, the layer constitution thereof may be varied in accordance with the manner mentioned above.

In order to improve the color reproducibility of the photographic material of the present invention, it is preferred to provide an interlayer effect donor layer (CL) having a different color sensitivity distribution from the other principle light-sensitive layers of BL, GL and RL, near to or adjacent to the principle light-sensitive layers, in accordance with the manner described in, for example, U.S. Pat. Nos. 4,663,271, 4,705,744 and 4,707,436, and JP-A-62-160448 and JP-A-63-89850.

As mentioned above, various layer constitutions and arrangements may be selected in accordance with the object of the photographic material of the invention.

The silver halide to be included in the photographic emulsion layer constituting the photographic material of the present invention is preferably silver iodobromide, silver iodochloride or silver iodochlorobromide having a silver iodide content of about 30 mol % or less. Especially preferred is a silver iodobromide or silver iodochlorobromide having a silver iodide content of from about 2 mol % to about 10 mol %.

The silver halide grains to be in the photographic emulsions constituting the photographic material of the present invention may be regular crystalline ones such as cubic, octahedral or tetradecahedral grains, or irregular crystalline ones such as spherical or tabular grains, or irregular crystalline ones having a crystal defect such as a twin plane, or composite crystalline ones composed of the above-mentioned regular and irregular crystalline forms.

Regarding the grain size of the silver halide grains, the grains may be fine grains having a small grain size of about 0.2 micron or less, or may be large ones having a large grain size of up to about 10 microns as the diameter of the projected area. The emulsion of the grains may be either a polydispersed emulsion or a monodispersed emulsion.

The silver halide photographic emulsions to be used in the present invention may be prepared by various methods, for example, those described in *Research Disclosure* (RD) No. 17643 (December, 1978), pages 22 to 23 (I. Emulsion Preparation and Types); RD No. 18716 (November, 1979), pages 648; RD No. 307105 (November, 1989); P. Glafkides, *Chimie et Physique Photographique* (published by Paul Montel, 1967 ); G. F. Duffin, *Photographic Emulsion Chemistry* (published by Focal Press, 1966); and V. L. Zelikman et al, *Making and Coating Photographic Emulsion* (published by Focal Press, 1964).

Monodispersed emulsions as described in U.S. Pat. Nos. 3,574,628 and 3,655,394 and British Patent 1,413,748 are also preferably used in the present invention.

Additionally, tabular grains having an aspect ratio of about 3 or more may also be used in the present invention. Such tabular grains may easily be prepared in accordance with the various methods, for example, as described in Gutoff, *Photographic Science and Engineering*, Vol. 14, pages 248 to 257 (1970); and U.S. Pat. Nos. 4,434,226, 4,414,310, 4,430,048, 4,439,520 and British Patent 2,112, 157.

Regarding the crystal structure of the silver halide grains constituting the emulsions of the invention, the grains may have the same halogen composition throughout the whole grain, or they may have different halogen compositions between the inside part and the outside part of one grain, or they may have a layered structure. Further, the grains may have different halogen compositions as conjugated by epitaxial bond, or they may have components other than silver halides, such as silver rhodanide or lead oxide, as conjugated with the silver halide matrix. Additionally, a mixture of various grains of different crystalline forms may be employed in the present invention.

The above-mentioned emulsions may be either surface latent image type emulsions which form latent images essentially on the surfaces of the grains, or internal latent image type emulsions which form latent images essentially in the inside of the grains, or they may also be composite emulsions which form latent images both on the surfaces of the grains and in the inside thereof. However, the emulsions must be negative ones. Of the latter internal latent image type emulsions, core/shell type internal latent image type emulsions described in JP-A-63-264740 are referred to. Preparation of such core/shell type internal latent image type emulsions is disclosed in JP-A-59-133542. The preferred thickness of the shell of the grains in the emulsion is, though varying in accordance with the method of development of the material, approximately from 3 to 40 nm, especially preferably from 5 to 20 nm.

The emulsions for use in the invention are generally physically ripened, chemically ripened and/or color-sensitized. Additives to be used in such a ripening or sensitizing step are described in *Research Disclosure* Nos. 17643, 18716 and 307105, and the related descriptions in these references as shown in the Table mentioned below.

In preparing the photographic material of the present invention, two or more light-sensitive silver halide emulsions which are different from one another with respect to at least one characteristic of the grain size, grain size distribution, halogen composition, shape of grains and sensitivity, may be blended and incorporated into one layer.

Surface-fogged silver halide grains as described in U.S. Pat. No. 4,082,553, inside-fogged silver halide grains as described in U.S. Pat. No. 4,626,498 and JP-A-59- 214852, and colloidal silver are preferably incorporated into the light-sensitive silver halide emulsion layers and/or substantially non-light-sensitive hydrophilic colloid layers constituting the photographic material of the present invention. Inside-fogged or surface-fogged silver halide grains are meant to be silver halide grains capable of being uniformly (or non-imagewise) developed, irrespective of the non-exposed part or exposed part of the photographic material containing them. Preparation of such inside-fogged or surface-fogged silver halide grains is described in U.S. Pat. No. 4,626,498 and JP-A-59-214852.

The silver halide forming the inside core of an inside-fogged core/shell type silver halide grain may have the same halogen composition as that of the shell thereof, or may have a different halogen from that of the latter. Such an inside-fogged or surface-fogged silver halide grain may be any of silver chloride, silver chlorobromide, silver iodobromide and silver chloroiodobromide grain. The grain size of the fogged silver halide grains is not particularly limited, but the grains are desired to have a mean grain size of from 0.01 to 0.75 μm, especially preferably from 0.05 to 0.6 μm. The grains are not also particularly limited with respect to the shape thereof. They may be regular grains or they may be in the form of a polydispersed emulsion. However, they are preferably in the form of a monodispersed emulsion (where at least 95% by number or by weight of all the silver halide grains therein have a grain size falling within the range of the mean grain size plus/minus 40%).

The photographic material of the present invention preferably contain non-light-sensitive fine silver halide grains. Non-light-sensitive fine silver halide grains are meant to be fine silver halide grains which are not sensitive to the light as imparted to the photographic material for imagewise exposure thereof, and are substantially not developed in the step of development of the exposed material. These fine grains are desired to be not previously fogged.

The fine silver halide grains have a silver bromide content of from 0 to 100 mol % and, if desired, they may additionally contain silver chloride and/or silver iodide. Preferably, they contain silver iodide in an amount of from 0.5 to 10 mol %.

The fine silver halide grains are desired to have a mean grain size (as a mean value of the circle-corresponding diameter of the projected area) of from 0.01 to 0.5 μm, more preferably from 0.02 to 0.2 μm.

The fine silver halide grains may be prepared by the same method as that of preparing ordinary light-sensitive silver halide grains. In this case, the surfaces of the fine silver halide grains to be prepared do not need to be optically sensitized, and color sensitization of the grains is unnecessary. However, prior to addition of the fine grains to the coating composition, it is desired to previously add a known stabilizer, such as triazole compounds, azaindene compounds, benzothiazolium compounds, mercapto compounds, or zinc compounds, to the coating composition. Incorporation of a colloidal silver into the fine silver halide grains-containing layer is also preferred.

In preparing the photographic material of the present invention, the amount of the silver to be contained therein is preferably 6.0 g/m$^2$ or less, most preferably 4.5 g/m$^2$ or less.

Various known photographic additives which may be used in preparing the photographic materials of the present invention are mentioned in the above-mentioned three Research Disclosures, and the related descriptions therein are shown in the following table.

| Kind of Additives | RD 17643 (Dec. 1978) | RD 18716 (Nov. 1979) | RD 307105 (Nov. 1989) |
|---|---|---|---|
| 1. Chemical Sensitizer | p. 23 | p. 648, right column | p. 866 |
| 2. Sensitivity Enhancer | | p. 648, right column | |
| 3. Spectral Sensitizer Supercolor Sensitizer | pp. 23 to 24 | p. 648, right column to p. 649, right column | pp. 866 to 868 |
| 4. Whitening Agent | p. 24 | p. 647, right column | p. 868 |
| 5. Anti-foggant Stabilizer | pp. 24 to 25 | p. 649, right column | pp. 868 to 870 |
| 6. Light-Absorbent Filter Dye Ultraviolet Absorbent | pp. 25 to 26 | p. 649, right column to p. 650, left column | p. 873 |
| 7. Stain Inhibitor | p. 25, right column | p. 650, left to right column | p. 872 |
| 8. Color Image Stabilizer | p. 25 | p. 650, left column | p. 872 |
| 9. Hardening Agent | p. 26 | p. 651, left column | pp. 874 to 875 |
| 10. Binder | p. 26 | p. 651, left column | pp. 873 to 874 |
| 11. Plasticizer Lubricant | p. 27 | p. 650, right column | p. 876 |
| 12. Coating Aid Surfactant | pp. 26 to 27 | p. 650, right column | pp. 875 to 876 |
| 13. Antistatic Agent | p. 27 | p. 650, right column | pp. 876 to 877 |
| 14. Mat Agent | | | pp. 878 to 879 |

In order to prevent deterioration of the photographic property of the photographic material of the invention by formaldehyde gas as imparted thereto, compounds capable of reacting with formaldehyde so as to solidify it, for example, those described in U.S. Pat. Nos. 4,411,987 and 4,435,503, are preferably incorporated into the material.

The photographic material of the present invention is desired to contain a mercapto compound as described in U.S. Pat. Nos. 4,740,454 and 4,788,132 and JP-A-62-18539 and JP-A-1-283551.

The material is also desired to contain a compound capable of releasing a foggant, a development accelerator, a silver halide solvent, or a precursor thereof, irrespective of the amount of the developed silver as formed by development, as described in JP-A-1-106052.

The material is also desired to contain a dye dispersion as dispersed by the method described in International Patent Laid-Open Application No. WO88/04794 and Japanese Patent Kohyo Koho Hei 1-502912 or a dye described in European Patent 317,308A, U.S. Pat. No. 4,420,555 and JP-A-1-259358.

Various color couplers can be incorporated into the photographic material of the present invention, and examples of usable color couplers are described in patent publications as referred to in the above-mentioned RD No. 17643, VII-C to G and RD No. 307105, VII-C to G.

As yellow couplers, for example, those described in U.S. Pat. Nos. 3,933,501, 4,022,620, 4,326,024, 4,401,752, 4,248,961, JP-B-58-10739, British Patents 1,425,020, 1,476, 760, U.S. Pat. Nos. 3,973,968, 4,314,023, 4,511,649, and European Patent 249,473A are preferred.

As magenta couplers, various known couplers can be used in combination with the couplers of the present invention. For instance, those described in U.S. Pat. Nos. 4,310,619, 4,351,897, European Patent 73,636, U.S. Pat. Nos. 3,061, 432, 3,725,045, RD No. 24220 (June, 1984), JP-A-60-33552, RD No. 24230 (June, 1984), JP-A-60-43659, JP-A-61- 72238, JP-A-60-35730, JP-A-55-118034, JP-A-60-185951, U.S. Pat. Nos. 4,500,630, 4,540,654, 4,556,630, and WO(PCT)- 88/04795 are preferably used. Among them, 5-pyrazolone compounds and pyrazoloazole compounds are preferred. However, the added amount of these known couplers should be within such a range that the effects of the present invention are not badly influenced by the addition of these known couplers.

As cyan couplers, phenol couplers and naphthol couplers are preferred. For instance, those described in U.S. Pat. Nos. 4,052,212, 4,146,396, 4,228,122, 4,296,200, 2,369,929, 2,801,171, 2,771,162, 2,895,816, 3,772,002, 3,758,308, 4,334,011, 4,327,173, West German Patent (OLS) No. 3,329,729, European Patents 121,365A, 249,453A, U.S. Pat. Nos. 3,446,622, 4,333,999, 4,753,871, 4,451,559, 4,427, 767, 4,690,889, 4,254,212, 4,296,199, and JP-A-61- 42658 are preferred. In addition, pyrazoloazole couplers described in JP-A-64-553, JP-A-64-554, JP-A-64-555 and JP-A-64-556, as well as imidazole couplers as described in U.S. Pat. No. 4,818,672 may also be used.

Polymerized dye-forming couplers may also be used, and typical examples of such couplers are described in U.S. Pat. Nos. 3,451,820, 4,080,211, 4,367,282, 4,409,320, 4,576, 910, British Patent 2,102,137, and European Patent 341, 184A.

Couplers capable of forming a colored dyes having a pertinent diffusibility may also be used, and those described in U.S. Pat. No. 4,366,237, British Patent 2,125,570, European Patent 96,570, and West German Patent OLS No. 3,234,533 are preferred.

As colored couplers for correcting the unnecessary absorption of colored dyes, those described in RD No. 17643, VII-G, RD No. 307105, VII-D, U.S. Pat. No. 4,163, 670, JP-B-57-39413, U.S. Pat. Nos. 4,004,929, 4,138,258, and British Patent 1,146,368 are preferred. Additionally, couplers for correcting the unnecessary absorption of the colored dyed by the phosphor dye to be released during coupling, as described in U.S. Pat. No. 4,774,181, as well as couplers having a dye precursor group capable of reacting with a developing agent to form a dye, as a split-off group, as described in U.S. Pat. No. 4,777,120, are also preferably used.

Couplers capable of releasing a photographically useful residue along with coupling may also be used in the present invention. For instance, as DIR couplers releasing a development inhibitor, those described in the patent publications as referred to in the above-mentioned RD No. 17643, Item VII-F and RD No. 307105, VII-F, as well as those described in JP-A-57-151944, JP-A-57-154234, JP-A- 60-184248, JP-A-63-37346 and JP-A-63-37350 and U.S. Pat. Nos. 4,248,962 and 4,782,012 are preferred.

Couplers releasing a bleaching accelerator, which are described in R.D. No. 11449, R.D. No. 24241 and JP-A-61-201247, are effective for shortening the processing time of the processing step with a processing solution having a bleaching ability. In particular, they are especially effectively added to photographic materials having the above-mentioned tabular silver halide grains.

As couplers for imagewise releasing a nucleating agent or development accelerator during development, those described in British Patents 2,097,140 and 2,131,188, and JP-A-59-157638 and JP-A-59-170840 are preferred. In addition, compounds capable of releasing a foggant, a development accelerator, or a silver halide solvent redox reaction of the material with the oxidation product of a developing agent, as described in JP-A-60-107029, JP-A- 60-252340 and JP-A-1-44940, are also preferably used.

Additionally, as examples of compounds which may be incorporated into the photographic materials of the present invention, there are further mentioned competing couplers described in U.S. Pat. No. 4,130,427; poly-valent couplers described in U.S. Pat. Nos. 4,238,472, 4,338,393 and 4,310, 618; DIR redox compound-releasing couplers, DIR coupler-releasing couplers, DIR coupler-releasing redox compounds and DIR redox-releasing redox compounds described in JP-A-60-185950 and JP-A-62-24252; couplers releasing a dye which recolors after being released from the coupler, as described in European Patents 173,302A and 313,308A; ligand-releasing couplers described in U.S. Pat. No. 4,553, 477; leuco dye-releasing couplers described in JP-A-63-75747; and couplers of releasing a phosphor dye as described in U.S. Pat. No. 4,774,181.

The above-mentioned couplers can be incorporated into the photographic materials of the present invention by various known dispersion methods.

For instance, an oil-in-water dispersion method may be employed for the purpose. Examples of high boiling point solvents usable in the method are described in U.S. Pat. No. 2,322,027. As examples of high boiling point organic solvents having a boiling point of 175° C. or higher at normal pressure, which are used in an oil-in-water dispersion, there are mentioned phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridocyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2-ethylhexyl) sebacate, dioctyl azelate, glycerol tributylate, isostearyl lactate, trioctyl citrate), aniline derivatives (e.g., N,N-dibutyl-2-butoxy-5-tert-octylaniline), and hydrocarbons (e.g., paraffin, dodecylbenzene, diisopropylnaphthalene). As an auxiliary solvent, organic solvents having a boiling point of approximately from 30° to 160° C., preferably from 50° to 160° C. can be used. As examples of such auxiliary organic solvents, there are mentioned ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps of carrying out the dispersion method, the effect of the method and examples of latexes usable in the method for impregnation are described in U.S. Pat. No. 4,199,363, German Patent (OLS) Nos. 2,541,174 and 2,541,130.

The color photographic materials of the present invention preferably contain phenethyl alcohol as well as other various antiseptics or fungicides, for example, those described in JP-A-63-257747, JP-A-62-272248 and JP-A- 1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

The present invention may apply to various color photographic materials. For instance, there are mentioned, as typical examples, color negative films for general use or for movie use, color reversal films for slide use or for television use, as well as color papers, color positive films and color reversal papers.

Suitable supports which are usable in the present invention are described in, for example, the above-mentioned RD No. 17643, page 28, RD No. 18716, from page 647, right column to page 648, left column, and RD No. 307105, page 879.

It is desired that the total film thickness of all the hydrophilic colloid layers as provided on the surface of the support of having emulsion layers is 28 microns or less, preferably 23 microns or less, more preferably 18 microns or less, especially preferably 16 microns or less, in the photographic material of the present invention. It is also desired that the photographic material of the invention has a film swelling rate (T ½) of 30 seconds or less, preferably 20 seconds or less. The film thickness as referred to herein is one as measured under the controlled condition of a temperature of 25° C. and a relative humidity of 55% (for 2 days); and the film swelling rate as referred to herein may be measured by any means known in this technical field. For instance, it may be measured by the use of a swellometer of the model as described in A. Green et al., Photographic Science Engineering, Vol. 19, No. 2, pages 124 to 129. The film swelling rate (T ½) is defined as follows: 90% of the maximum swollen thickness of the photographic material as processed in a color developer under the condition of 30° C. and 3 minutes and 15 seconds is called a saturated swollen thickness. The time necessary for attaining one half (½) of the saturated swollen thickness is defined to be a film swelling rate (T ½).

The film swelling rate (T ½) can be adjusted by adding a hardening agent to gelatin of a binder or by varying the conditions for storing the coated photographic material. Additionally, the photographic material of the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness—original film thickness)/(original film thickness).

It is desired that the photographic material of the present invention has a hydrophilic colloid layer (backing layer) having a total dry thickness of from 2 microns to 20 microns, on the surface opposite to the surface coated with emulsion layers. The backing layer is desired to contain the above-mentioned light-absorbent, filter dye, ultraviolet absorbent, antistatic agent, hardening agent, binder, plasticizer, lubricant, coating aid, surfactant, etc. The backing layer is desired to have a swelling degree of from 150 to 500%.

The color photographic material of the present invention can be developed by any ordinary method, for example, in accordance with the process described in the above-mentioned RD No. 17643, pages 28 and 29, RD No. 8716, page 615, from left column to right column, and RD No. 307105, pages 880 and 881.

The color developer to be used for development of the photographic material of the present invention is preferably an aqueous alkaline solution consisting essentially of an aromatic primary amine color-developing agent. As the color-developing agent, p-phenylenediamine compounds are preferably used, though aminophenol compounds are also useful. Specific examples of p-phenylenediamine compounds usable as the color-developing agent include 3-methyl-4-amino-N,N-diethylaniline, 3 -methyl-4-amino-N-ethyl-N-β-hydroxyethylaniline, 3-methyl- 4-amino-N-ethyl- N-β-methanesulfoneamidoethylaniline, 3 -methyl-4-amino-N-ethyl-N-β-methoxyethylaniline, as well as sulfates, hydrochlorides and p-toluenesulfonates of the compounds. Above all, 3-methyl-4-amino-N-ethyl-N-β-hydroxyethylaniline sulfate is especially preferred. These compounds can be used in combination of two or more of them, in accordance with the object.

The color developer generally contains a pH buffer such as alkali metal carbonates, borates or phosphates, and a development inhibitor or anti-foggant such as bromides, iodides, benzimidazoles, benzothiazoles or mercapto compounds. If desired, it may also contain various preservatives such as hydroxylamine, diethylhydroxylamine, sulfites, hydrazines such as N,N-biscarboxymethylhydrazine, phenylsemicarbazides, triethanolamine, catechol-sulfonic acids; an organic solvent such as ethylene glycol, and diethylene glycol; a development accelerator such as benzyl alcohol, polyethylene glycol, quaternary ammonium salts, and amines; a dye-forming coupler; a competing coupler; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. As specific examples of chelating agents which may be incorporated into the color developer, there are mentioned ethylenediamine-tetraacetic acid, nitrilo-triacetic acid, diethylenetriamine-pentaacetic acid, cyclohexanediamine-tetraacetic acid, hydroxylethylimino-diacetic acid, 1-hydroxy-ethylidene-1,1 -diphosphonic acid, nitrilo-N,N,N-trimethylenephosphonic acid, ethylenediamine-N,N,N,N-tetramethylene-phosphonic acid, ethylenediamine-di(o-hydroxyphenylacetic acid), and their salts.

Where the photographic material is processed for reversal finish, in general, it is first subjected to black-and-white development and then subjected to color development. For the first black-and-white development is used a black-and-white developer, which contains a conventional black-and-white developing agent, for example, dihydroxybenzenes such as hydroquinone, 3-pyrazolidones such as 1-phenyl-3-pyrazolidone, or aminophenols such as N-methyl-p-aminophenol, singly or in combination.

The color developer and the black-and-white developer generally has a pH value of from 9 to 12. The amount of the replenisher to the developer is, though dependent upon the the color photographic material to be processed, generally 3 liters or less per $m^2$ of the material to be processed. It may be reduced to 500 ml or less per $m^2$ of the material to be processed, by lowering the bromide ion concentration in the replenisher. Where the amount of the replenisher is reduced, it is preferred to reduce the contact area of the surface of the processing solution in the processing tank with air, so as to prevent vaporization and aerial oxidation of the solution.

The contact surface area of the processing solution with air in the processing tank is represented by the opening ratio, which is defined by the following formula:

Opening Ratio= (Contact Surface Area (cm2) of Processing Solution with Air)/(Volume (cm3) of Processing Tank)

The above-mentioned opening ratio is preferably 0.1 or less, more preferably from 0,001 to 0.05. Various means can be employed for the purpose of reducing the opening ratio, which include, for example, provision of a masking substance, such as a floating lid on the surface of the processing solution in the processing tank, employment of the mobile lid described in JP-A-1-82033, and employment of the slit-developing method described in JP-A-63-216050. Reduction of the opening ratio is preferably applied to not only the both steps of color development and black-and-white development but also all the subsequent steps such as bleaching, bleach-fixation, fixation, rinsing and stabilization steps. In addition, the amount of the replenisher to be added may also be reduced by means of suppressing accumulation of bromide ions in the developer.

The time for color development is generally within the range of from 2 minutes to 5 minutes, but the processing time may be shortened by elevating the processing temperature, elevating the pH value of the processing solution and elevating the concentration of the processing solution.

After color developing, the photographic emulsion layer is generally bleached. Bleaching may be effected simultaneously with fixation (bleach-fixation) or separately therefrom. In order to accelerate the processing speed, a system of bleaching followed by bleach-fixation may also be employed. If desired, a system of using a bleach-fixing bath of two continuous tanks, a system of fixation followed by bleach-fixation, or a system of bleach-fixation followed by bleaching may also be employed, in accordance with the object. As the-bleaching agent can be used, for example, compounds of polyvalent metals such as iron(III), as well as peracids, quinones and nitro compounds. Specific examples of the bleaching agent usable in the present invention include organic complexes of iron(III), such as complexes thereof with amino-polycarboxylic acids such as ethylenediaminetetraacetic acid, diethylenetriaminepentaacetic acid, cyclohexanediamine-tetraacetic acid, methyliminodiacetic acid, 1,3-diaminopropane-tetraacetic acid or glycol etherdiamine-tetraacetic acid, or with organic acids such as citric acid, tartaric acid or malic acid. Among them, aminopolycarboxylato/iron(III) complexes such as ethylenediaminetetraacetato/iron(III) complex and 1,3 -diaminopropane-tetraacetato/iron(III) complex are preferred in view of the rapid processability thereof, and of prevention of environmental pollution. The aminopolycarboxylato/iron(III) complexes are especially useful both in a bleaching solution and in a bleach-fixing solution. The bleaching solution or bleach-fixing solution containing such aminopolycarboxylato/iron(III) complexes generally has a pH value of from 4.0 to 8.0, but the solution may have a lower pH value for rapid processing.

The bleaching solution, the bleach-fixing solution and the previous bath may contain a bleaching accelerating agent, if desired. Various bleaching accelerating agents are known, and examples of the agents which are advantageously used in the present invention include mercapto group- or disulfide group-containing compounds described in U.S. Pat. No. 3,893,858, German Patents 1,290,812 and 2,059,988, JP-A-53-32736, JP-A-53-57831, JP-A- 53-37418, JP-A-53-72623, JP-A-53-95630, JP-A-53-95631, JP-A-53-104232, JP-A-53-124424, JP-A-53-141623 and JP-A- 53-28426, RD No. 17129 (July, 1978); thiazolidine derivatives as described in JP-A-50-140129; thiourea derivatives as described in JP-B-45-8506, JP-A-52-20832 and JP-A-53-32735 and U.S. Pat. No. 3,706,561; iodide salts as described in German Patent 1,127,715 and JP-A-58-16235; polyoxyethylene compounds as described in German Patents 966,410 and 2,748,430; polyamine compounds as described in JP-B-45-8836; other compounds as described in JP-A-49-40943, JP-A-49-59644, JP-A-53-94927, JP-A-54-35727, JP-A-55-26506 and JP-A-58-163940; and bromide ions. Above all, mercapto group- or disulfide group-containing compounds, in particular, those as described in U.S. Pat. No. 3,893,858, German Patent 1,290,812 and JP-A-53- 95630 are preferred, as having a large accelerating effect. In addition, compounds described in U.S. Pat. No. 4,552,834 are also preferred. These bleaching accelerators may be incorporated into the photographic material of the invention. Where the material of the invention is a picture-taking color photographic material and it is bleach-fixed, these bleaching accelerators are especially effective.

The bleaching solution and bleach-fixing solution may further contain, in addition to the above-mentioned components, various organic acids for the purpose of preventing bleaching stains. Especially preferred organic acids for this purpose are those having an acid dissociating constant (pKa) of from 2 to 5. For instance, acetic acid, propionic acid and hydroxyacetic acid are preferably used.

As the fixing agent in the fixing solution or bleach-fixing solution to be applied to the photographic material of the invention, usable are thiosulfates, thiocyanates, thioether compounds, thioureas, and a large number of iodide salts. Use of thiosulfates is general for the purpose. Above all, ammonium thiosulfate is most widely used. Additionally, combinations of thiosulfates and thiocyanates, thioether compounds or thioureas is also preferred. As the preservative to be used in the fixing solution or bleach-fixing solution, preferred are sulfites, bisulfites and carbonyl-bisulfite adducts, as well as sulfinic acid compounds as described in European Patent 294769A. Further, the fixing solution or bleach-fixing solution may preferably contain various aminopolycarboxylic acids or organic phosphonic acids for the purpose of stabilizing the solution.

In the present invention, the fixing solution or bleach-fixing solution preferably contains compounds having a pKa value of from 6.0 to 9.0, preferably imidazoles such as unsubstituted imidazole, 1-methylimidazole, 1-ethylimidazole or 2-methylimidazole, in an amount of from 0.1 to 10 mol/liter, for the purpose of adjusting the pH value of the solution.

The total time for the desilvering process is preferably shorter, within the range of not causing desilvering insufficiency. For instance, the time is preferably from 1 minute to 3 minutes, more preferably from 1 minute to 2 minutes. The processing temperature may be from 25° C. to 50° C., preferably from 35° C. to 45° C. In such a preferred temperature range, the desilvering speed is accelerated and generation of stains in the processed material may effectively be prevented.

In the desilvering process, it is desired that stirring of the processing solution during the process be promoted as much as possible. As examples of reinforced stirring means for forcedly stirring the photographic material during the desilvering step, there are mentioned a method of running a jet stream of the processing solution to the emulsion-coated surface of the material, as described in JP-A-62-183460; a method of promoting the stirring effect by the use of a rotating means, as described in JP-A-62-183461; a method of moving the photographic material being processed in the processing bath while the emulsion-coated surface of the material is brought into contact with a wiper blade as provided in the processing bath, whereby the processing solution as applied to the emulsion-coated surface of the material is made turbulent and the stirring effect is promoted; and a method of increasing the total circulating amount of the processing solution. Such reinforced stirring means are effective with any of the bleaching solution, bleach-fixing solution, and fixing solution. It is considered that reinforcement of stirring of the processing solution would promote penetration of the bleaching agent and fixing agent into the emulsion layer of the photographic material being processed and, as a result, the desilvering rate in processing the material would be elevated. The above-mentioned reinforced stirring means is more effective, when a bleaching accelerator is incorporated into the processing solution. Because of the reinforced stirring means, therefore, the bleaching accelerating effect could remarkably be augmented, and the fixation preventing effect by the bleaching accelerator could be evaded.

The photographic material of the present invention can be processed with an automatic developing machine. It is desired that the automatic developing machine to be used for processing the material of the present invention is equipped with a photographic material-conveying means as described in JP-A-60-191257, JP-A-60-191258, and JP-A- 60-191259. As is noted from the related disclosure of JP-A- 60-191257, the conveying means may noticeably reduce the carry-over amount from the previous bath to the subsequent bath, and therefore it is extremely effective for preventing deterioration of the processing solution being used. Because of these reasons, the conveying means is especially effective for shortening the processing time in each processing step, and for reducing the amount of the replenisher to each processing bath.

The silver halide color photographic material of the present invention is generally rinsed in water and/or stabilized, after being desilvered. The amount of the water to be used in the rinsing step can be set in a broad range, in accordance with the characteristic of the photographic material being processed (for example, depending upon the raw material components, such as the coupler and so on) or the use of the material, as well as the temperature of the rinsing water, the number of the rinsing tanks (the number of the rinsing stages), whether the replenishment system is normal current or countercurrent, and other various kinds of conditions. Among these conditions, the relation between the number of the rinsing tanks and the amount of the rinsing water in a multi-stage countercurrent rinsing system can be obtained by the method described in *Journal of the Society of Motion Picture and Television Engineers*, Vol. 64, pages 248 to 253 (May, 1955).

According to the multi-stage countercurrent system described in the above-mentioned reference, the amount of the rinsing water to be used can be reduced noticeably, but because of the prolongation of the residence time of the water in the rinsing tank, bacteria would propagate in the tank, so that the floating substances generated by the propagation of bacteria would adhere to the surface of the material as it was processed. Accordingly, the above system would often have a problem. In the practice of processing the photographic material of the present invention, the method of reducing calcium and magnesium ions, which is described in JP-A-62-288838, can extremely effectively be used for overcoming this problem. In addition, isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), *Bactericidal and Fungicidal Techniques to Microorganisms*, edited by Association of Sanitary Technique, Japan (1982, by Kogyo Gijutsu-kai, Japan), and *Encyclopeadia of Bactericidal and Fungicidal Agents*, edited by Nippon Bactericide and Fungicide Association, Japan (1986), can also be used.

The pH value of the rinsing water to be used for processing the photographic material of the present invention is from 4 to 9, preferably from 5 to 8. The temperature of the rinsing water and the rinsing time can also be set variously in accordance with the characteristics of the photographic material being processed as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic material of the present invention may also be processed directly with a stabilizing solution, in place of being rinsed with water. For the stabilization, any known methods, for example, as described in JP-A-57-8543, JP-A-58-14834 and JP-A-60- 220345, can be employed.

In addition, the material can also be stabilized, following the rinsing step. As one example of this stabilization, there may be mentioned a stabilizing bath containing a dye stabilizer and a surfactant, which is used as a final bath for picture-taking color photographic materials. As examples of dye stabilizers usable for the purpose, there are mentioned aldehydes such as formalin and glutaraldehyde, N-methylol compounds, hexamethylenetetramine and aldehyde-sulfite adducts.

The stabilizing bath may also contain various chelating agents and fungicides.

The overflow from the rinsing and/or stabilizing solutions, because of addition of replenishers thereto, may be re-used in the other steps such as the previous desilvering step.

Where the photographic material of the present invention is processed with an automatic developing machine system and the processing solutions being used in each step are evaporated and thickened, it is desired to add water to the solutions so as to correct the concentration of the solutions.

The silver halide color photographic material of the present invention can contain a color developing agent for the purpose of simplifying and accelerating the processing of the material. For incorporation of a color developing agent into the photographic material, various precursors of the agent are preferably used. For example, there are mentioned indoaniline compounds described in U.S. Pat. No. 3,342,597, Schiff base compounds described in U.S. Pat. No. 3,342,599 and RD Nos. 14850 and 15159, aldole compounds described in RD No. 13924, metal complexes described in U.S. Pat. No. 3,719,492 and urethane compounds described in JP-A-53-135628, as the precursors.

The silver halide color photographic material of the present invention can contain various kinds of 1 -phenyl-3-pyrazolidones, if desired, for the purpose of accelerating the color developability thereof. Specific examples of these compounds are described in JP-A-56- 64339, JP-A-57-144547 and JP-A-58-115438.

The processing solutions for the photographic material of the invention are used at 10° C. to 50° C. In general, a processing temperature of from 33° C. to 38° C. is standard, but the temperature may be made higher so as to accelerate the processing or to shorten the processing time, or on the contrary, the temperature may be made lower so as to improve the quality of images formed and to improve the stability of the processing solution used.

The present invention is also applicable to heat-developing photographic materials as described in U.S. Pat. No. 4,500,626, JP-A-60-133449, JP-A-59-218443 and JP-A-61-238056 and European Patent 210,660A2.

Next, the present invention will be explained in more detail by way of the following examples, which, however, are not intended to restrict the scope of the present invention.

EXAMPLE 1

Preparation of Sample No. 101:

Plural layers mentioned below were formed on a cellulose triacetate film support having a subbing layer, to form a multi-layer color photographic material sample (Sample No. 101).

Compositions of Layers:

The numbers corresponding to the respective components mentioned below indicate the amounts coated, which were represented by the unit of g/m$^2$. For silver halides, the number indicates the amount (g/m$^2$) of silver therein. For additives and gelatin, the number indicates the amount (g/m$^2$) thereof as coated. For couplers, the number indicates the amount (mmol/m$^2$) thereof as coated.

| Sample No. 101: | |
|---|---|
| First Layer: Emulsion Layer | |
| Emulsion A | 0.30 as Ag |
| Emulsion B | 0.30 as Ag |
| Sensitizing Dye IV | $6.0 \times 10^{-5}$ |
| Sensitizing Dye V | $2.0 \times 10^{-4}$ |
| Sensitizing Dye VI | $7.6 \times 10^{-4}$ |
| Magenta Coupler(R-1) | 0.58 |
| HBS-1 | 0.20 |
| Gelatin | 1.26 |
| Second Layer: First Protective Layer | |
| U-4 | 0.11 |
| U-5 | 0.17 |
| HBS-1 | $5.0 \times 10^{-2}$ |
| Gelatin | 1.00 |
| Third Layer: Second Protective Layer | |
| H-1 | 0.40 |
| B-1 (a polymer latex dispersion: average particle diameter 1.7 μm) | $5.0 \times 10^{-2}$ |
| B-2 (a polymer latex dispersion: average particle diameter 1.7 μm) | 0.10 |
| B-3 | 0.10 |
| S-1 | 0.20 |
| Gelatin | 1.20 |

TABLE 2

| Emulsion | Mean AgI Content (%) | Mean Grain Size (μm) | Fluctuation Coefficient of Grain Size (%) | Ratio of Diameter/ Thickness | Silver Amount Ratio (AgI content %) |
|---|---|---|---|---|---|
| Emulsion A | 4.0 | 0.45 | 27 | 1 | core/shell = 1/3 (13/1), two-layer structure grains |
| Emulsion B | 8.9 | 0.70 | 14 | 1 | core/shell = 3/7 (25/2), two-layer structure grains |

HBS 1
Tricresyl Phosphate

Sensitizing Dye IV

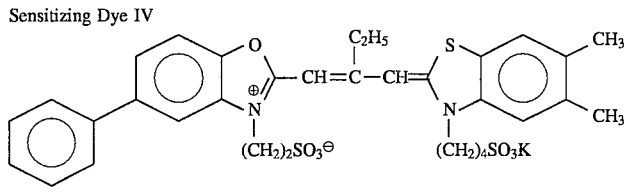

-continued
Sensitizing Dye V
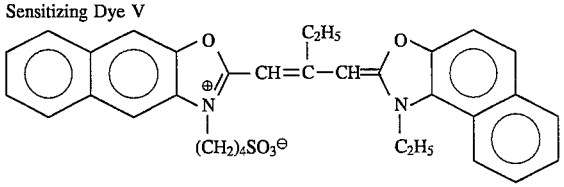
Sensitizing Dye VI
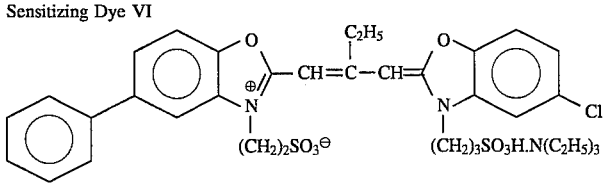
B-1
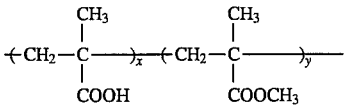
x/y = 10/90 (wt %)
B-2
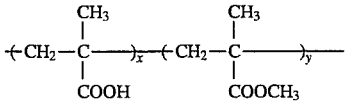
x/y = 40/60 (wt %)
B-3
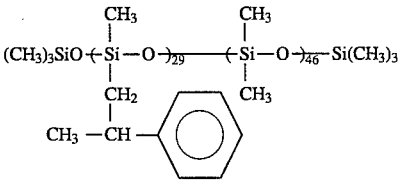
U-4
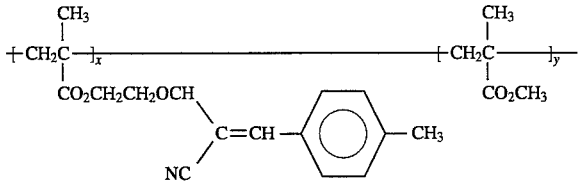
x:y = 70:30 (wt %)
U-5
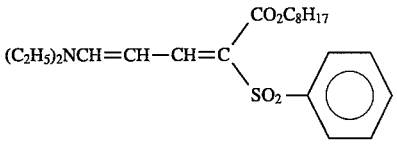
S-1
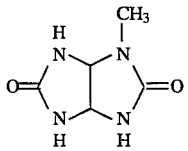
H-1
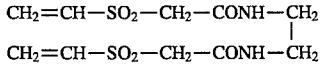
Sample Nos. 102 to 117 were prepared in the same manner as Sample No. 101, except that the magenta coupler was changed as shown in Table 3.
The photographic material sample prepared above were imagewise exposed, and then processed in accordance with the process (A) mentioned below.

| Step | Time | Process (A) Temperature | Amount of Replenisher | Tank Capacity |
|---|---|---|---|---|
| Color Development | 3 min 15 sec | 37.8° C. | 25 ml | 10 liters |
| Bleaching | 45 sec | 38.0° C. | 5 ml | 5 liters |
| Fixation (1) | 45 sec | 38.0° C. | — | 5 liters |
| Fixation (2) | 45 sec | 38.0° C. | 30 ml | 5 liters |
| Stabilization (1) | 15 sec | 38.0° C. | — | 5 liters |
| Stabilization (2) | 15 sec | 38.0° C. | — | 5 liters |
| Stabilization (3) | 15 sec | 38.0° C. | 35 ml | 5 liters |
| Drying | 1 min | 55° C. | | |

Amount of replenisher is per m of 35 mm-wide sample.

Fixation was effected by counter current system from (2) to (1).

Stabilization was effected by countercurrent system from (3) to (2) to (1).

The amount of of carryover of the developer to the bleaching step and that of the fixer to the stabilizing step were 2.5 ml, respectively, per m of 35 mm-step wide sample.

The processing solutions used above are mentioned below.

-continued

| | | |
|---|---|---|
| Water to make | 1.0 liter | 1.0 liter |
| pH | 4.8 | 3.4 |
| Fixing Solution: Mother solution (g) and replenisher (g) were the same. | | |
| Disodium Ethylenediaminetetraacetate | | 1.7 |
| Sodium Sulfite | | 14.0 |
| Sodium Bisulfite | | 10.0 |
| Ammonium Thiosulfate Aqueous Solution (70% w/v) | | 210.0 ml |
| Ammonium Thiocyanate | | 163.0 |
| Thiourea | | 1.8 |
| Water to make | | 1.0liter |
| pH | | 6.5 |
| Stabilizing Solution: Mother solution (g) and replenisher (g) were the same. | | |
| Surfactant SUR-1 | | 0.5 |
| Surfactant SUR-2 | | 0.4 |
| Triethanolamine | | 2.0 |
| 1,2-Benzisothiazolin-3-one Methanol | | 0.3 |
| Formalin (37%) | | 1.5 |
| Water to make | | 1.0liter |
| pH | | 6.5 |

Surfactants SUR-1 and SUR-2 have the following structural formulae, respectively.

Surfactant SUR-1

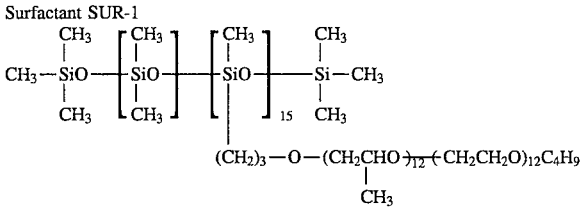

Surfactant SUR-2

$C_{10}H_{21}-O-(CH_2CH_2O)_{10}-H$

| | Mother Solution (g) | Replenisher (g) |
|---|---|---|
| Color Developer: | | |
| Diethylenetriaminepenta-acetic Acid | 5.0 | 6.0 |
| Sodium Sulfite | 4.0 | 5.0 |
| Potassium Carbonate | 30.0 | 37.0 |
| Potassium Bromide | 1.3 | 0.5 |
| Potassium Iodide | 1.2 mg | — |
| Hydroxylamine Sulfate | 2.0 | 3.6 |
| 4-[N-ethyl-N-β-hydroxyethyl-amino]-2-methylaniline Sulfate | 4.7 | 6.2 |
| Water to make | 1.0 liter | 1.0 liter |
| pH | 10.00 | 10.15 |
| Bleaching Solution: | | |
| Ammonium 1,3-Diaminopropane-tetraacetato/Ferric Complex Monohydrate | 144.0 | 206.0 |
| 1,3-Diaminopropanetetraacetic Acid | 2.8 | 4.0 |
| Ammonium Bromide | 84.0 | 120.0 |
| Ammonium Nitrate | 17.5 | 25.0 |
| Aqueous Ammonia (27%) | 10.0 | 1.8 |
| Acetic Acid (98%) | 46.0 | 65.7 |

The photographic properties of the samples were evaluated by Dmin (minimum density) and Dmax (maximum density) of the processed sample.

The samples were stored under the conditions of 60° C. and 30% RH and under the conditions of 25° C. and 30% RH each for 14 days, before exposure, and they were exposed and processed in the manner mentioned above. The depression of Dmax of each of the samples as stored under the conditions of 60° C. and 30% RH was obtained by [Dmax (25°–30%)–Dmax (60°–30%)]. Evaluation of the image fastness was effected as follows: Immediately after processing, Dmax of the processed sample was measured, and the processed sample was stored under the conditions of 60° C. and 70% RH for one month. Dmax of the stored sample was measured. The difference between Dmax of the fresh sample and Dmax of the stored sample was obtained, which indicates the image fastness of the sample.

The results obtained are shown in Table 3 below.

TABLE 3

| Sample No. | Magenta Coupler | δ* | Photographic Property Dmin | Photographic Property Dmax | Depression of Density (Dmax) of Stored Sample | Fading under Wet Heat | Remarks |
|---|---|---|---|---|---|---|---|
| 101 | R-1 | +0.85 | 0.12 | 1.80 | −0.09 | −0.20 | Comnparative Sample |
| 102 | R-2 | +0.49 | +0.17 | 2.40 | −0.61 | −0.24 | " |
| 103 | R-3 | +0.85 | 0.16 | 2.20 | −0.02 | −0.20 | " |
| 104 | M-1 | " | +0.12 | 2.29 | −0.02 | −0.09 | Sample of the Invention |
| 105 | M-2 | " | +0.12 | 2.28 | −0.02 | −0.08 | " |
| 106 | M-5 | " | +0.12 | 2.29 | −0.02 | −0.09 | " |
| 107 | M-6 | " | +0.11 | 2.20 | −0.02 | −0.09 | " |
| 108 | M-8 | +0.86 | +0.12 | 2.21 | −0.02 | −0.09 | " |
| 109 | M-9 | +0.88 | +0.12 | 2.23 | −0.02 | −0.08 | " |
| 110 | M-10 | +0.52 | +0.13 | 2.21 | −0.02 | −0.08 | " |
| 111 | M-11 | +0.85 | +0.12 | 2.23 | −0.02 | −0.09 | " |
| 112 | M-12 | " | +0.12 | 2.21 | −0.02 | −0.09 | " |
| 113 | M-17 | " | +0.12 | 2.20 | −0.02 | −0.09 | " |
| 114 | M-28 | " | +0.12 | 2.20 | −0.02 | −0.09 | " |
| 115 | R-4 | +0.85 | +0.12 | 2.20 | −0.02 | −0.18 | Comparative Sample |
| 116 | R-5 | +0.50 | +0.16 | 2.20 | −0.04 | −0.16 | " |
| 117 | R-6 | +0.00 | +0.17 | 2.30 | −0.04 | −0.20 | " |

R-1:
Megenta Coupler (17) described in JP-A-62-209457

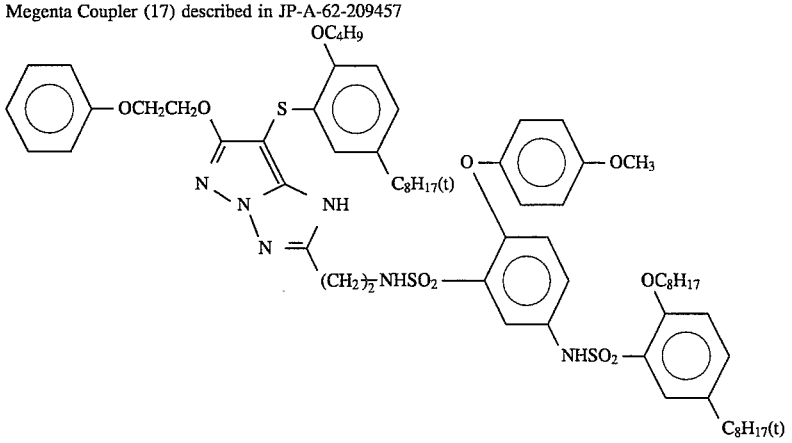

R-2:
Megenta Coupler (6) described in JP-A-62-209457

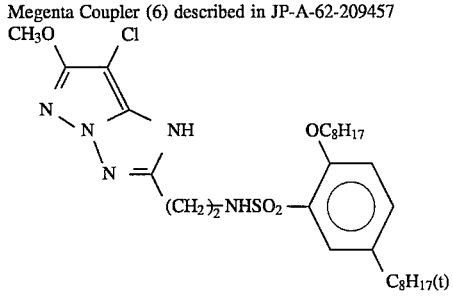

-continued

R-3:
Megenta Coupler (E-14) described in JP-A-2-59584

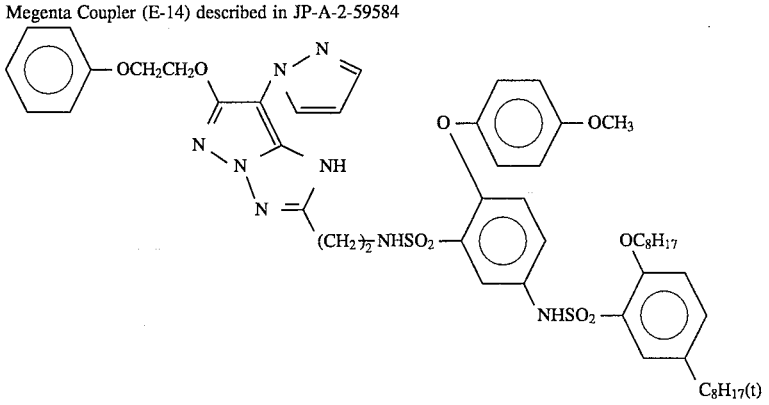

R-4:

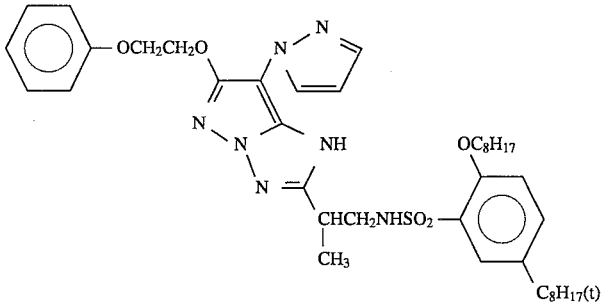

R-5:

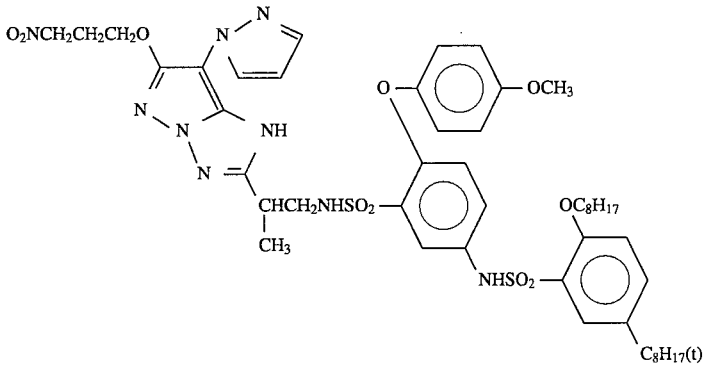

R-6:

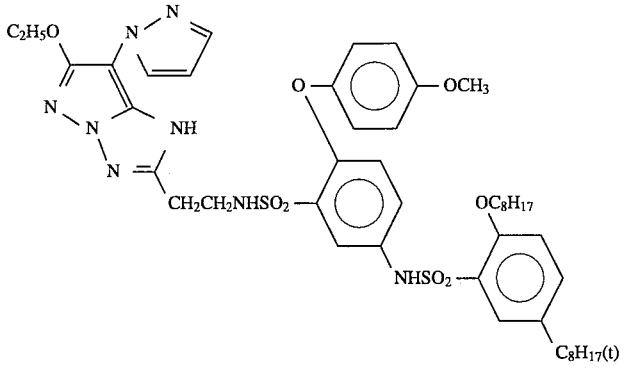

As shown by the data in Table 3 above, all the samples containing the coupler of the present invention formed color images having a high color density, and the raw film stability and the storage stability of them are extremely good. More precisely, the color density of the image formed in the samples of the present invention as stored before exposure was still high (improved raw film storability), and that formed in the samples of the present invention as stored after processing was also still high (improved storage stability).

EXAMPLE 2

Plural layers each having the composition mentioned below were formed on a cellulose triacetate film support having a subbing layer, to prepare a multi-layer color photographic material sample No. 201.

Compositions of Layers:

The numbers corresponding to the respective components mentioned below indicate the amounts coated, which were represented by the unit of $g/m^2$. For silver halides, the number indicates the amount ($g/m^2$) of silver therein. For sensitizing dyes, the number indicates the molar amount thereof per mol of the silver halide in the same layer.

| Sample No. 201: | |
|---|---|
| First Layer: Anti-halation Layer | |
| Black Colloidal Silver | 0.18 as Ag |
| Gelatin | 1.40 |
| Second Layer: Interlayer | |
| 2,5-Di-t-pentadecylhydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third Layer: First Red-sensitive Emulsion Layer | |
| Emulsion A | 0.25 as Ag |
| Emulsion B | 0.25 as Ag |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2 | 0.17 |
| EX-10 | 0.020 |
| EX-14 | 0.17 |
| U-1 | 0.070 |
| U-2 | 0.050 |
| U-3 | 0.070 |
| HBS-1 | 0.060 |
| Gelatin | 0.87 |
| Fourth Layer: Second Red-sensitive Emulsion Layer | |
| Emulsion G | 1.00 as Ag |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2 | 0.20 |
| EX-3 | 0.050 |
| EX-10 | 0.015 |
| EX-14 | 0.20 |
| EX-15 | 0.050 |
| U-1 | 0.070 |
| U-2 | 0.050 |
| U-3 | 0.070 |
| Gelatin | 1.30 |
| Fifth Layer: Third Red-sensitive Emulsion Layer | |
| Emulsion D | 1.60 as Ag |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-2 | 0.097 |
| EX-3 | 0.010 |
| EX-4 | 0.080 |
| HBS-1 | 0.22 |
| HBS-2 | 0.10 |

-continued

| Sample No. 201: | |
|---|---|
| Gelatin | 1.63 |
| Sixth Layer: Interlayer | |
| EX-5 | 0.040 |
| HBS-1 | 0.020 |
| Gelatin | 0.80 |
| Seventh Layer: First Green-sensitive Emulsion Layer | |
| Emulsion A | 0.15 as Ag |
| Emulsion B | 0.15 as Ag |
| Sensitizing Dye IV | $3.0 \times 10^{-5}$ |
| Sensitizing Dye V | $1.0 \times 10^{-4}$ |
| Sensitizing Dye VI | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| Eighth Layer: Second Green-sensitive Emulsion Layer | |
| Emulsion C | 0.45 as Ag |
| Sensitizing Dye IV | $2.1 \times 10^{-5}$ |
| Sensitizing Dye V | $7.0 \times 10^{-5}$ |
| Sensitizing Dye VI | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Ninth Layer: Third Green-sensitive Emulsion Layer | |
| Emulsion E | 1.20 as Ag |
| Sensitizing Dye IV | $3.5 \times 10^{-5}$ |
| Sensitizing Dye V | $8.0 \times 10^{-5}$ |
| Sensitizing Dye VI | $3.0 \times 10^{-4}$ |
| EX-1 | 0.013 |
| EX-11 | 0.065 |
| EX-13 | 0.019 |
| HBS-1 | 0.25 |
| HBS-2 | 0.10 |
| Gelatin | 1.54 |
| Tenth Layer: Yellow Filter Layer | |
| Yellow Colloidal Silver | 0.050 as Ag |
| EX-5 | 0.080 |
| HBS-1 | 0.030 |
| Gelatin | 0.95 |
| Eleventh Layer: First Blue-sensitive Emulsion Layer | |
| Emulsion A | 0.080 as Ag |
| Emulsion B | 0.070 as Ag |
| Emulsion F | 0.070 as Ag |
| Sensitizing Dye VII | $3.5 \times 10^{-4}$ |
| EX-8 | 0.042 |
| EX-9 | 0.72 |
| HBS-1 | 0.28 |
| Gelatin | 1.10 |
| Twelfth Layer: Second Blue-sensitive Emulsion Layer | |
| Emulsion G | 0.45 as Ag |
| Sensitizing Dye VII | $2.1 \times 10^{-4}$ |
| EX-9 | 0.15 |
| EX-10 | $7.0 \times 10^{-3}$ |
| HBS-1 | 0.050 |
| Gelatin | 0.78 |
| Thirteenth Layer: Third Blue-sensitive Emulsion Layer | |
| Emulsion H | 0.77 as Ag |
| Sensitizing Dye VII | $2.2 \times 10^{-4}$ |
| EX-9 | 0.20 |
| HBS-1 | 0.070 |
| Gelatin | 0.69 |

-continued

| Sample No. 201: | |
|---|---|
| Fourteenth Layer: First Protective Layer | |
| Emulsion I | 0.20 as Ag |
| U-4 | 0.11 |
| U-5 | 0.17 |
| HBS-1 | $5.0 \times 10^{-2}$ |
| Gelatin | 1.00 |
| Fifteenth Layer: Second Protective Layer | |
| H-1 | 0.40 |
| B-1 (a polymer latex dispersion: average particle diameter 1.7 μm) | $5.0 \times 10^{-2}$ |
| B-2 (a polymer latex dispersion: average particle diameter 1.7 μm) | 0.10 |

-continued

| Sample No. 201: | |
|---|---|
| B-3 | 0.10 |
| S-1 | 0.20 |
| Gelatin | 1.20 |

In addition, in order to improve the storability, processability, pressure resistance, antifungal and antibacterial property, antistatic property and coatability, W-1, W-2, W-3, B-4, B-5, F-1, F-2, F-3, F-4, F-5, F-6, F-7, F-8, F-9, F-10, F-11, F-12, F-13 and iron salt, lead salt, gold salt, platinum salt, iridium salt and rhodium salt were added to all the layers.

TABLE 4

| Emulsion | Mean AgI Content (%) | Mean Grain Size (μm) | Fluctuation Coefficient of Grain Size (%) | Ratio of Diameter/ Thickness | Silver Amount Ratio (AgI content %) |
|---|---|---|---|---|---|
| Emulsion A | 4.0 | 0.45 | 27 | 1 | core/shell = 1/3 (13/1), two-layer structure grains |
| Emulsion B | 8.9 | 0.70 | 14 | 1 | core/shell = 3/7 (25/2), two-layer structure grains |
| Emulsion C | 10 | 0.75 | 30 | 2 | core/shell = 1/2 (24/3), two-layer structure grains |
| Emulsion D | 16 | 1.05 | 35 | 2 | core/shell = 4/6 (40/0), two-layer structure grains |
| Emulsion E | 10 | 1.05 | 35 | 3 | core/shell = 1/2 (24/3), two-layer structure grains |
| Emulsion F | 4.0 | 0.25 | 28 | 1 | core/shell = 1/3 (13/1), two-layer structure grains |
| Emulsion G | 14.0 | 0.75 | 25 | 2 | core/shell = 1/2 (42/0), two-layer structure grains |
| Emulsion H | 14.5 | 1.30 | 25 | 3 | core/shell = 37/63 (34/3), two-layer structure grains |
| Emulsion I | 1 | 0.07 | 15 | 1 | uniform grains |

EX-1

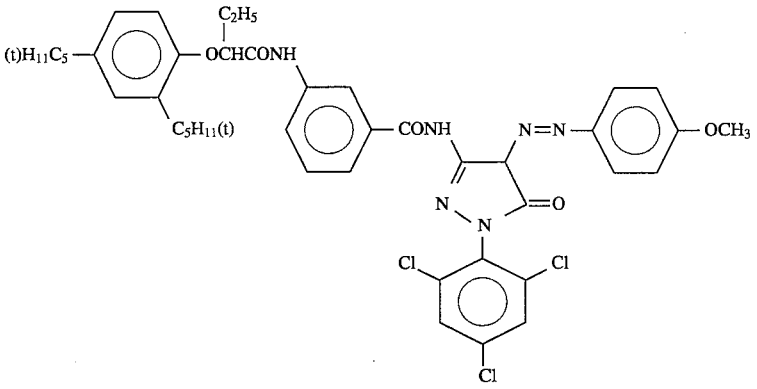

EX-2

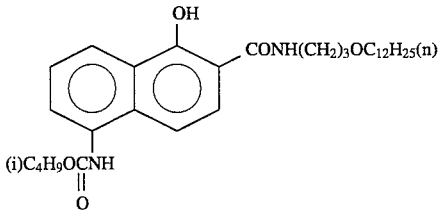

EX-3

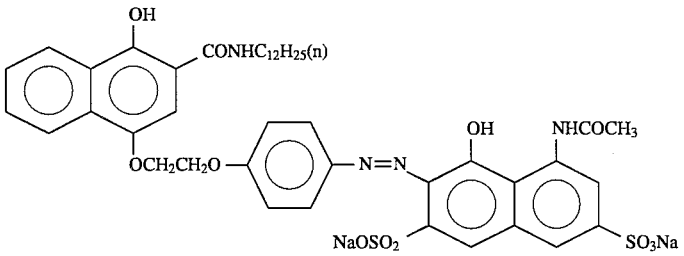

-continued
EX-4
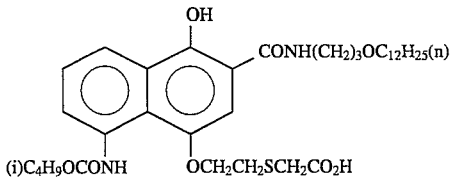
EX-5
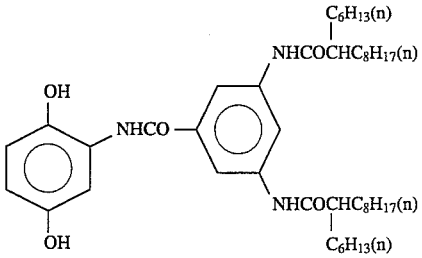
EX-6
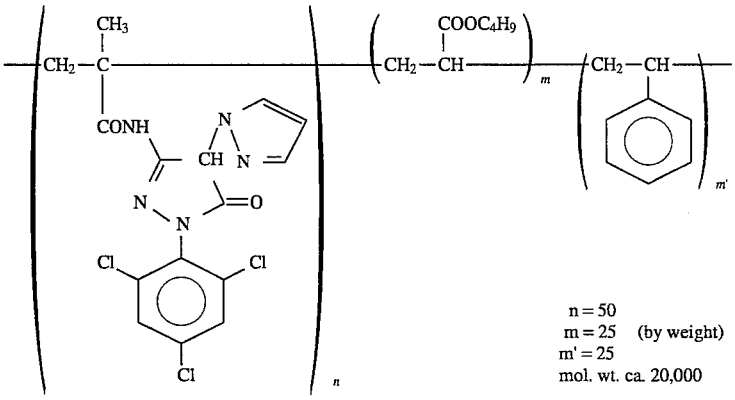
n = 50
m = 25 (by weight)
m' = 25
mol. wt. ca. 20,000
EX-7
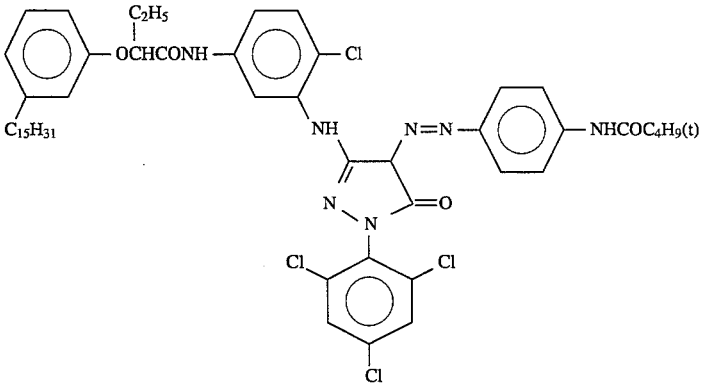
EX-8
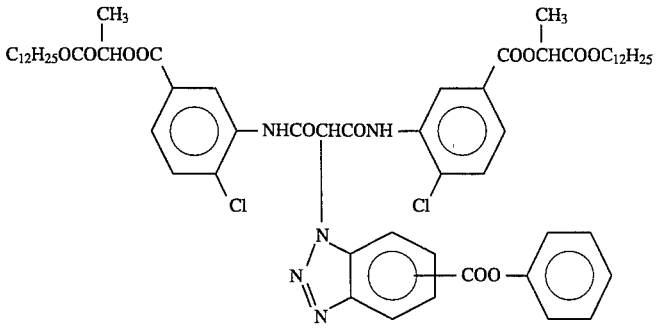

-continued
EX-9
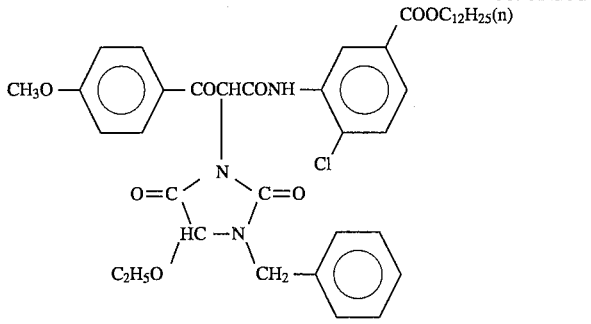
EX-10
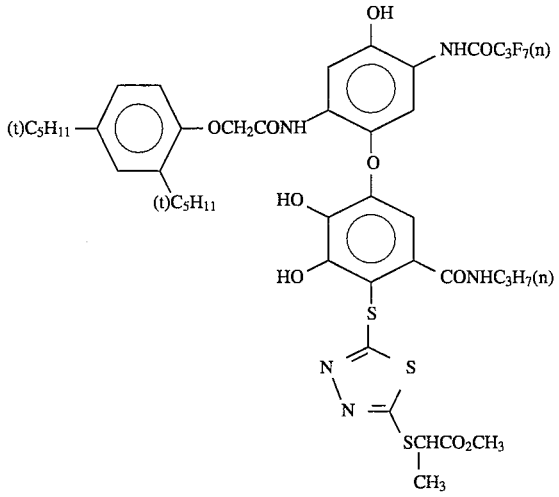
EX-11
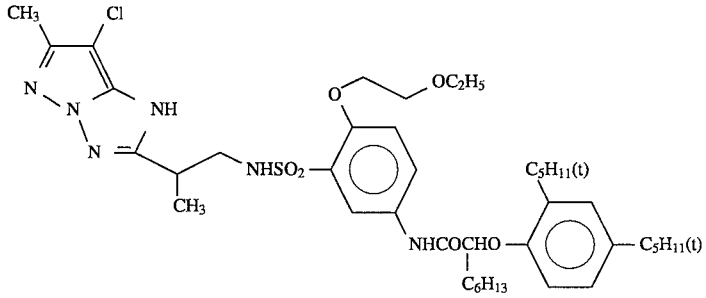
EX-12
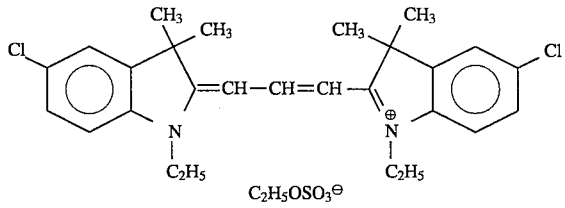
EX-13
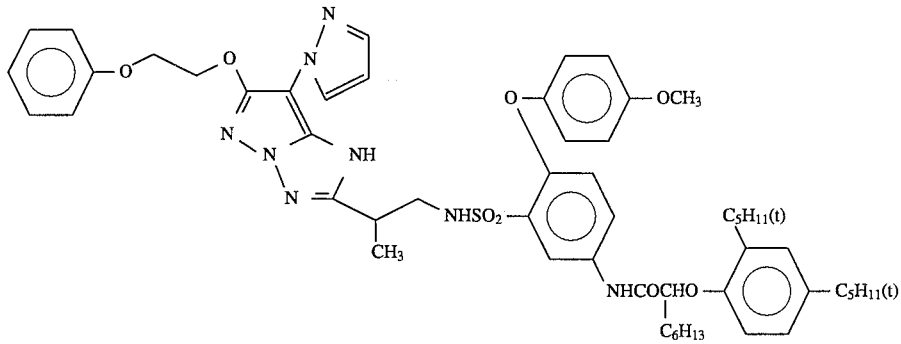

-continued
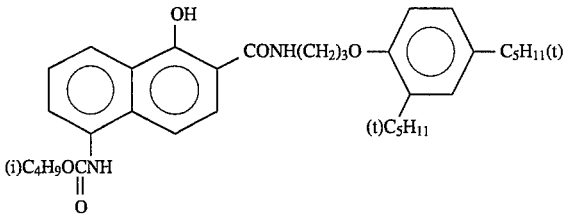
EX-14
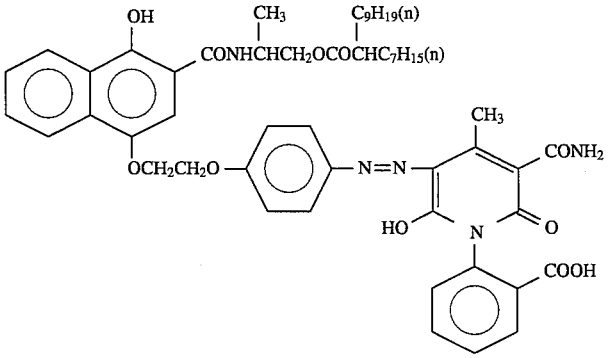
EX-15
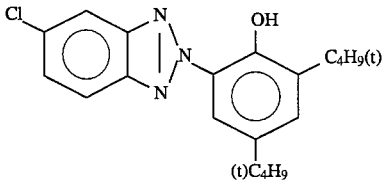
U-1
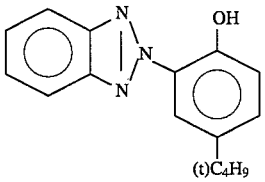
U-2
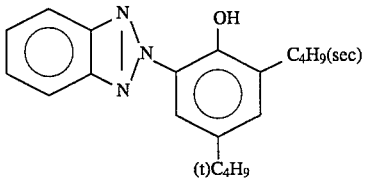
U-3
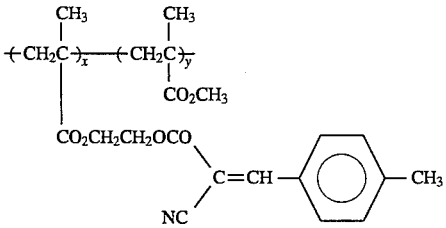
x:y = 70:30 (wt %)
U-4
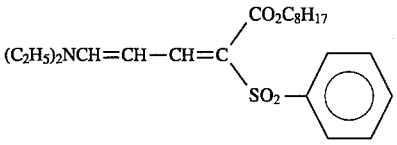
U-5
Tricresyl phosphate HBS-1
Di-n-butyl phthalate HBS-2

-continued
HBS-3
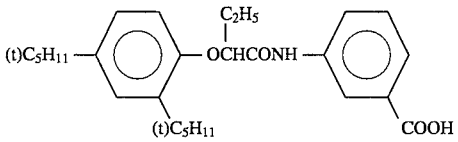
Sensitizing Dye I
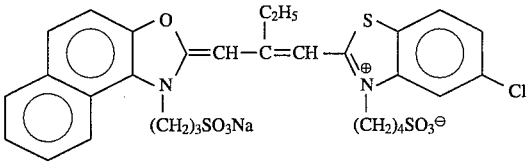
Sensitizing Dye II
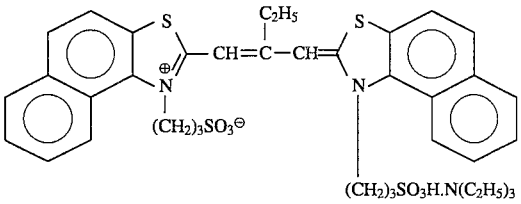
Sensitizing Dye III
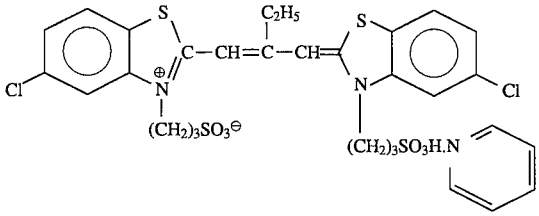
Sensitizing Dye IV
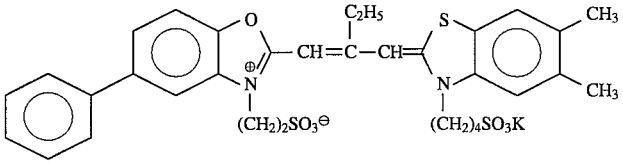
Sensitizing Dye V
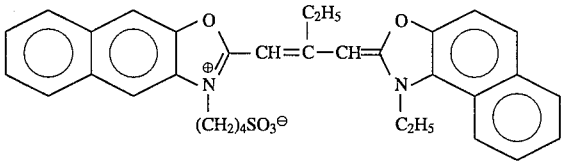
Sensitizing Dye VI
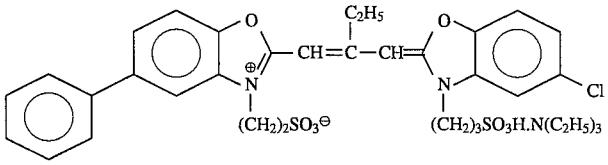
Sensitizing Dye VII
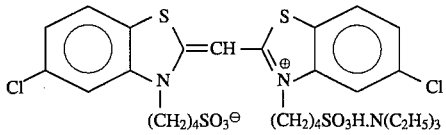
S-1
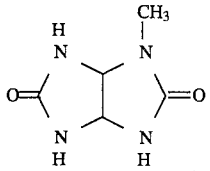
H-1
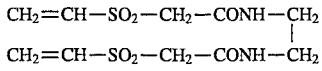

-continued
B-1
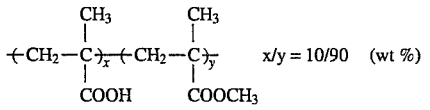
x/y = 10/90 (wt %)
B-2
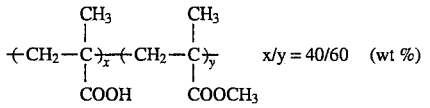
x/y = 40/60 (wt %)
B-3
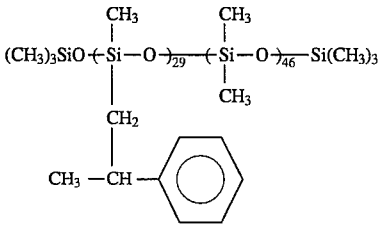
B-4
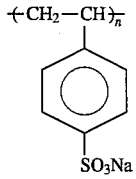
mol. wt.
ca. 350,000
B-5
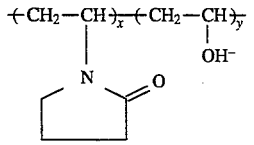
x/y = 70/30 (wt %)
W-1
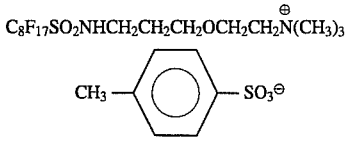
W-2
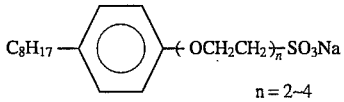
n = 2~4
W-3
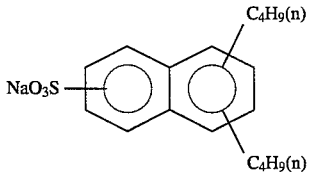
F-1
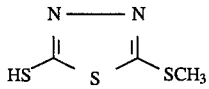
F-2
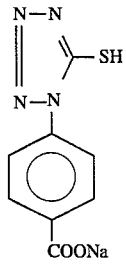

-continued
F-3
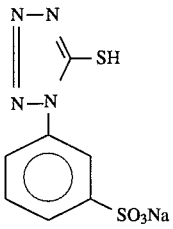
F-4
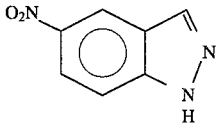
F-5
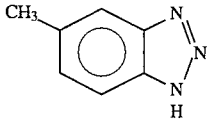
F-6
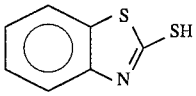
F-7
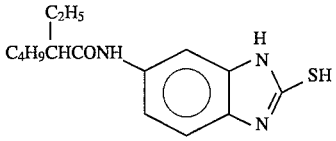
F-8
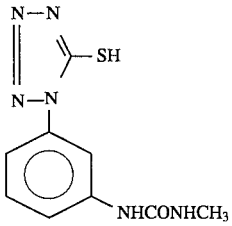
F-9
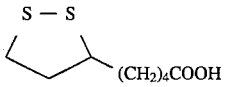
F-10
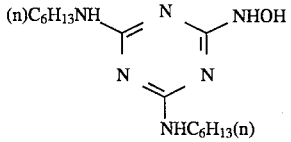
F-11
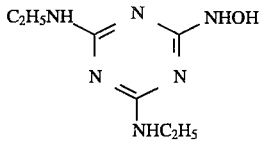
F-12
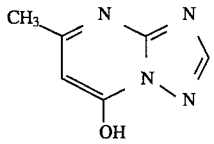
F-13
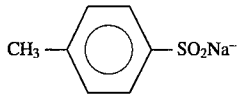

Other photographic material samples were prepared in the same manner as above, except that the magenta coupler EX-13 in the ninth layer (green-sensitive layer) was replaced by one of the couplers indicated in Table 5 below.

These samples were stored under the conditions of 50° C. and 30% RH and under the conditions of 25° C. and 30% R for 14 days, then imagewise exposed and processed in the same manner as in Example 1. The depression of the density of the processed sample as stored under the condition of 50° C. and 30% RH was obtained on the basis of the magenta density of the sample of being 1.0, as stored under the condition of 25° C. and 30% RH.

The results obtained are shown in Table 5 below.

TABLE 5

| Sample No. | Magenta Coupler | Depression of Density of Stored Sample ($\Delta D_G$) | Remarks |
|---|---|---|---|
| 201 | M-1* | −0.02 | sample of the invention |
| 202 | R-2** | −0.20 | comparative sample |
| 203 | M-3 | −0.02 | sample of the invention |
| 204 | M-7 | −0.01 | sample of the invention |
| 205 | M-9 | −0.02 | sample of the invention |
| 206 | M-11 | −0.02 | sample of the invention |
| 207 | M-14 | −0.02 | sample of the invention |
| 208 | M-17 | −0.02 | sample of the invention |
| 209 | M-21 | −0.02 | sample of the invention |
| 210 | M-22 | −0.02 | sample of the invention |

M-1*: Same as Ex13
R-2**: Same as that used in Example 1

As is obvious from Table 5 above, the density variation of the samples containing the coupler of the present invention is extremely small before and after storage of them.

EXAMPLE 3

Sample 101 of Example 1 of JP-A 2-854 was prepared, using the same molar amount of magenta coupler (M-1) of the present invention in place of the magenta coupler therein. This displayed excellent color forming capacity, image fastness and storage stability, like the sample of the previous Example 1 of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having at least one silver halide emulsion layer on a support, in which at least one layer constituting the material comprises a coupler having formula (I):

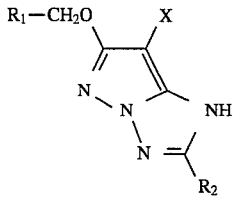

(I)

wherein $R_1$ represents an electron-attracting substituent having a Taft's substituent constant σ* value of +0.52 or more; X represents a pyrazolyl group, and $R_2$ in formula (I) is a group having formula (V):

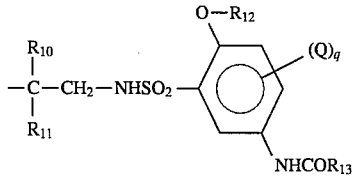

(V)

wherein $R_{10}$ and $R_{11}$ each represents a hydrogen atom, an alkyl group, or an aryl group, but both $R_{10}$ and $R_{11}$ must not be hydrogen atoms; $R_{12}$ represents an alkyl group or an aryl group; Q represents a substituent; q represents an integer of from 0 to 3; and $R_{13}$ represents an alkyl group or an aryl group.

2. The silver halide color photographic material as claimed in claim 1, wherein $R_1$ has a Taft's substituent constant σ* value of +0.52 to +1.30.

3. The silver halide color photographic material as claimed in claim 2, wherein $R_1$ has a Taft's substituent constant σ* value of +0.52 to +0.92.

4. The silver halide color photographic material as claimed in claim 1, wherein $R_1$ is selected from the group consisting of methoxymethyl, hydroxymethyl, phenyl, phenoxymethyl, and 2,2,2-trichloroethyl groups.

5. The silver halide color photographic material as claimed in claim 1, wherein X represents an unsubstituted pyrazolyl group.

6. The silver halide color photographic material as claimed in claim 1, wherein $R_1$ in formula (I) is a group having formula (II):

$$-CH_2O-R_3 \quad \text{(II)}$$

wherein $R_3$ represents an alkyl group or an aryl group.

7. The silver halide color photographic material as claimed in claim 6, wherein $R_3$ represents a phenyl group.

8. The silver halide color photographic material as claimed in claim 6, wherein $R_3$ is an alkyl group containing 1 to 36 carbon atoms or an aryl group containing 6 to 36 carbon atoms.

9. The silver halide color photographic material as claimed in claim 1, wherein Q is selected from the group consisting of halogen, cyano, carboxy, hydroxy, alkoxy, aryloxy, alkylthio, arylthio, alkoxycarbonyl, acylamino, sulfonamido, ureido, sulfamoylamino, anilino, carbamoyl, sulfamoyl, alkoxycarbonylamino, sulfonyl, and amino groups.

10. The silver halide color photographic material as claimed in claim 1, wherein when $R_{13}$ is an alkyl group, the alkyl group contains 1 to 50 carbon atoms, and when $R_{13}$ is an aryl group, the aryl group contains 6 to 50 carbon atoms.

11. The silver halide color photographic material as claimed in claim 1, wherein $R_{12}$ is a phenyl group.

12. The silver halide color photographic material as claimed in claim 1, wherein when $R_{10}$ or $R_{11}$ are each an alkyl group, each of these alkyl groups contains 1 to 20 carbon atoms, and when $R_{10}$ or $R_{11}$ are each an aryl group, each of these aryl groups contains 6 to 20 carbon atoms.

13. The silver halide color photographic material as claimed in claim 1, wherein $R_{12}$ is an alkyl group containing 1 to 50 carbon atoms or an aryl group containing 6 to 42 carbon atoms.

14. The silver halide color photographic material as claimed in claim 1, wherein $R_{10}$, $R_{11}$, $R_{12}$ or $R_{13}$ are substituted alkyl groups or substituted aryl groups wherein the substituents are selected from the group consisting of a halogen atom, a cyano group, a carboxyl group, a hydroxyl group, an alkoxy group, an aryloxy group, an alkylthio group, an arylthio group, an alkoxycarbonyl group, an acyloxy group, an acylamino group, a sulfonamido group, an ureido group, a sulfamoylamino group, an anilino group, a carbamoyl group, a sulfamoyl group, an alkoxycarbonyl amino group, and a sulfonyl group.

* * * * *